US009046111B2

(12) United States Patent
Harvey et al.

(10) Patent No.: US 9,046,111 B2
(45) Date of Patent: Jun. 2, 2015

(54) COMPRESSOR AEROFOIL

(75) Inventors: Neil W. Harvey, Derby (GB); John J. Bolger, Derby (GB)

(73) Assignee: ROLLS-ROYCE PLC, London (GB)

( * ) Notice: Subject to any disclaimer, the term of this patent is extended or adjusted under 35 U.S.C. 154(b) by 814 days.

(21) Appl. No.: 13/030,609

(22) Filed: Feb. 18, 2011

(65) Prior Publication Data

US 2011/0206527 A1 Aug. 25, 2011

(30) Foreign Application Priority Data

Feb. 24, 2010 (GB) ..... 1003084.9

(51) Int. Cl.

| | |
|---|---|
| ***F01D 5/14*** | (2006.01) |
| ***F04D 29/32*** | (2006.01) |
| ***F04D 29/66*** | (2006.01) |
| ***F04D 29/54*** | (2006.01) |
| ***F04D 29/68*** | (2006.01) |

(52) U.S. Cl.

CPC ..... *F04D 29/324* (2013.01); *F01D 5/141* (2013.01); *F04D 29/666* (2013.01); *F04D 29/544* (2013.01); *F04D 29/681* (2013.01)

(58) Field of Classification Search

CPC ... F04D 29/324; F04D 29/681; F04D 29/544; F04D 29/666; F01D 5/14; F01D 5/141

See application file for complete search history.

(56) References Cited

U.S. PATENT DOCUMENTS

| | | | |
|---|---|---|---|
| 3,014,640 | A | 12/1961 | Barney et al. |
| 3,588,005 | A | 6/1971 | Rethorst |
| 3,697,193 | A | 10/1972 | Phillips |
| 3,993,414 | A | 11/1976 | Meauze et al. |
| 4,354,648 | A | 10/1982 | Schenk et al. |
| 4,434,957 | A | 3/1984 | Moritz |
| 4,706,910 | A | 11/1987 | Walsh et al. |

(Continued)

FOREIGN PATENT DOCUMENTS

| | | | | |
|---|---|---|---|---|
| CH | 228273 | * | 8/1943 | ..... F01D 5/14 |
| CH | 228273 | A | 11/1943 | |

(Continued)

OTHER PUBLICATIONS

Search Report issued in British Application No. GB1003084.9 dated Jun. 10, 2010.

Ottavy et al., "The Effects of Wake-Passing Unsteadiness Over a Highly-Loaded Compressor-Like Flat Plate," Proceedings of ASME Turbo Expo 2002, Jun. 3-6, 2002, pp. 1-13.

(Continued)

*Primary Examiner* — Nathaniel Wiehe
*Assistant Examiner* — Jeffrey A Brownson
(74) *Attorney, Agent, or Firm* — Oliff PLC

(57) ABSTRACT

An aerofoil for a compressor comprising a suction surface and a pressure surface with a thickness distribution defined therebetween, the aerofoil further comprising a first local maximum in the thickness distribution and a second local maximum in the thickness distribution, the second local maximum being downstream of the first local maximum and the second local maxima being formed by a first region of concave curvature in the suction surface between the first and second local maxima, wherein the second local maximum is disposed such that in use a boundary layer upstream of the second local maximum on the suction surface is thinned by the second local maximum, and in addition the boundary layer may be sufficiently thinned so that an interaction of an upstream flow feature with the thinned boundary layer is capable of generating a turbulent spot with a calmed region downstream of the turbulent spot.

23 Claims, 27 Drawing Sheets

(56) References Cited

U.S. PATENT DOCUMENTS

| | | | | |
|---|---|---|---|---|
| 4,720,239 | A * | 1/1988 | Owczarek | 415/181 |
| 4,822,249 | A | 4/1989 | Eckardt et al. | |
| 4,846,629 | A | 7/1989 | Takigawa | |
| 5,395,071 | A | 3/1995 | Felix | |
| 5,540,406 | A | 7/1996 | Occhipinti | |
| 5,904,470 | A | 5/1999 | Kerrebrock et al. | |
| 6,416,289 | B1 | 7/2002 | Ramesh et al. | |
| 6,908,287 | B2 * | 6/2005 | Cho et al. | 416/189 |
| 7,384,240 | B2 * | 6/2008 | McMillan et al. | 416/131 |
| 8,911,215 | B2 | 12/2014 | Cornelius et al. | |

FOREIGN PATENT DOCUMENTS

| | | | |
|---|---|---|---|
| EP | 1 152 122 | A2 | 11/2001 |
| EP | 1930599 | A2 | 6/2008 |
| GB | 580806 | | 9/1946 |
| GB | 1079606 | | 8/1967 |
| GB | 1 270 156 | | 4/1972 |
| GB | 2 436 861 | A | 10/2007 |

OTHER PUBLICATIONS

Wheeler et al., "The Effect of Wake Induced Structures on Compressor Boundary-Layers," Proceedings of GT2006 ASME Turbo Expo 2006: Power for Land, Sea and Air, May 8-11, 2006, pp. 1-11.

Wheeler et al., "The Effect of Leading-Edge Geometry on Wake Interactions in Compressors," Proceedings of GT2007 ASME Turbo Expo 2007: Power for Land, Sea and Air, May 14-17, 2007, pp. 1-11.

Goodhand et al., "Compressor Leading Edge Spikes: A New Performance Criterion," Proceedings of ASME Turbo Expo 2009: Power for Land, Sea and Air, Jun. 8-12, 2009, pp. 1-10.

Wheeler et al., "Compressor Wake/Leading-Edge Interactions at Off Design Incidences," Proceedings of ASME Turbo Expo 2008: Power for Land, Sea and Air, Jun. 9-13, 2008, pp. 1-12.

Binder et al., "Turbulence Measurements in a Multistage Low-Pressure Turbine," Gas Turbine and Aeroengine Congress and Exposition, Jun. 5-9, 1988, pp. 1-11.

Jun. 19, 2014 Partial European Search Report issued in European Patent Application No. 11154940.

* cited by examiner

COMPRESSOR AEROFOIL

This invention relates to a compressor aerofoil and particularly, but not exclusively, relates to an aerofoil for an axial flow compressor or fan, which may be found in gas turbines for aero, marine or land-based use.

BACKGROUND

Axial flow compressors and some fans feature stages of paired rows of rotors followed by stators. The compressor may consist of many such stages. Due to viscous effects thin regions or boundary layers of low momentum fluid form adjacent to the aerofoil surface. Typically these, are shed from the trailing edge of each aerofoil as wakes which impinge periodically onto the aerofoils of the next downstream row.

FIG. 1 depicts a typical compressor blade. The aerofoil has a leading edge 104 and a trailing edge 106, a suction surface 100 and a pressure surface 102. The pressure on the suction surface is usually lower than that of the pressure surface in normal operation which generates lift and enables the aerofoil to turn the flow through it. For a conventional aerofoil operating in largely subsonic flow the suction surface is generally convex and the pressure surface flat or concave.

The aerofoil shape is characterised by distributions of thickness and camber along its chord extending between the leading and trailing edges. The camber defines the curve of the aerofoil mean line between the suction and pressure surfaces.

Fluid entering the compressor row does so at an inlet flow angle $\beta_1$, which will vary over the range of operation of the compressor. All angles are measured relative to the axial direction of the engine. The inlet angle can differ from the physical inlet angle of the aerofoil itself, $\beta_{m,1}$. In addition, the flow adjacent the leading edge may experience "upwash" which results in the angle of flow impinging onto the leading edge to be different to the bulk inlet flow angle of the fluid. This is shown as $\beta_1'$. The difference between $\beta_{m,1}$ and $\beta_1'$ is known as incidence. The variation of $\beta_1$ from the value at the aerofoil design angle is referred to as the inlet flow angle deviation.

Aerodynamic performance for an aerofoil may be recorded as a "loss loop" that plots aerodynamic loss along the ordinate against the inlet flow angle deviation along the abscissa. Typically, at extremes of deviation, the aerodynamic loss will greater than at lesser inlet flow angle deviations.

One definition for the operating range of the aerofoil is to locate the points at positive and negative inlet flow angle deviation at which the aerofoil loss is double that at the design flow condition. Outside this range the aerofoil section is taken to have stalled aerodynamically i.e. the boundary layer will have separated from one of the aerofoil surfaces. Once this happens it is likely the compressor will become aerodynamically unstable and surge.

At the trailing edge 106 the physical exit angle of the aerofoil is shown as $\beta_{m,2}$ and the exit angle of the fluid as $\beta_2$. For a two dimensional flow past an aerofoil the exit flow angle will always be greater than the physical angle and the difference between the two is known as the deviation.

Current compressor aerofoil design is still very much based on steady flow design criteria. FIG. 2 shows a schematic representation of a modern "controlled diffusion" aerofoil, plotting Mach number (on the ordinate) against fractional chord (on the abscissa)—taken from "Compressor Aerodynamics" (N A Cumpsty, Krieger Publishing Company, 2004). In this case the aerofoil is "supercritical", that is it features transonic flow over part of the suction surface.

However, the form of the velocity distribution may be understood to also apply to a blade with wholly subsonic flow over its surfaces.

Since this is a compressor aerofoil, the bulk flow through it diffuses and thus the exit velocity is below that at inlet. The lift sustained by the aerofoil is a function of the area between the suction 2 and pressure 4 surface lines in FIG. 2 is achieved by elevating the free stream velocity over the suction surface such that the free stream velocity on the suction surface accelerates rapidly from the leading edge stagnation point to a peak within the first 30% of the aerofoil chord. Rapid acceleration is achieved by having the maximum thickness and aerofoil camber in the early part of the aerofoil.

The acceleration is such that the boundary layer remains laminar in this region, even for compressor aerofoils with high Reynolds numbers (typically values of a few million are possible, based on aerofoil chord and inlet flow conditions). After this the flow decelerates to the exit velocity. The deceleration is sharp at first, when the boundary layer is relatively thin and can sustain the deceleration without separating. In this region, shortly after peak velocity the boundary layer will typically undergo rapid transition from laminar to turbulent. In some cases this may be via a small, but closed, separation bubble. After transition the now turbulent boundary layer grows as the flow diffuses. As it thickens it becomes less able to sustain diffusion without separation so the diffusion gradient is generally reduced as the trailing edge is approached. A compressor aerofoil exhibits an overall level of deceleration (or diffusion) on the suction surface that is much higher than the deceleration exhibited by a typical turbine aerofoil. Accordingly, the velocity distribution is much more forward loaded to be able to achieve workable diffusion gradients.

For conventional compressor aerofoils in steady flow there is a rapid transition from laminar to turbulent flow on the early suction surface with the boundary layer downstream of the transition point being fully turbulent. In a laminar boundary layer the flow is smooth and proceeds in streamlines roughly parallel to the surface whilst in turbulent flow there is a general mean motion roughly parallel to the surface but there are also rapid, random fluctuations in velocity which can be of the order of a tenth of the main stream velocity. A turbulent boundary layer has a greater drag than a laminar boundary layer which means it grows more rapidly than a corresponding laminar layer.

The fullness of the boundary layer profile may be characterised by its shape factor. Often designated $H_{12}$, this is defined as the ratio of the values of the displacement and momentum thicknesses. The displacement thickness is the thickness of a fluid layer at the free stream velocity at the edge of the boundary layer which would have a mass flow equal to the total mass flow in the boundary layer, whilst the momentum thickness is the thickness of a fluid layer at the free stream velocity at the edge of the boundary layer which would have a momentum flux equal to the total momentum flux in the boundary layer.

Initial research into unsteady flow effects on compressor aerofoils has shown that the flow field is complex with wakes and vortical flow features generated by upstream blade rows impinging on the following downstream rows. Because of the diffusing nature of the flow in a compressor the wakes mix out relatively quickly and discrete effects from them are usually only seen in the downstream row.

One piece of research (Ottavy et al., ASME GT-2002-30354.) used a flat plate experiment which had a surface velocity distribution representative of a typical compressor aerofoil suction surface. It also had a wake generator upstream of the flat plate which produced unsteady inlet conditions representative of the real compressor environment. There was a resulting complex interaction between incoming wakes and the early part of the suction surface boundary layer but the rear half of the suction surface had a turbulent and, on a time averaged basis, slightly thicker boundary layer than that observed in steady flow conditions. No observations were made that the unsteady flow could be beneficially exploited to reduce aerofoil loss.

A further series of experiments have been conducted on a stator row downstream of a rotor in a low speed research rig at Cambridge University. Results from this have been published by Wheeler et al., ASME GT2006-90892, GT2007-27802 and GT2008-50177; and by Goodhand and Miller ASME GT2009-59205. These examined the interaction of the unsteady flow with the leading edge geometry of the stator, and the subsequent development of the suction surface boundary layer. Depending on the severity of the interaction of incoming wakes with the leading edge, this turbulent boundary layer was periodically thickened, above the value that would be seen in steady flow. Shaping of the leading edge reduced these effects. However, the boundary layer on the late suction surface was found to remain turbulent.

The unsteady effects are described in more detail in FIG. 3, taken from Wheeler et at ASME GT2006-90892. This presents a time-space diagram showing the time-varying (periodic) boundary layer states for the suction surface of a mid-height section of a stator aerofoil tested in a low speed research compressor. The fractional distance along the aerofoil chord from the leading edge to the trailing edge is given along the abscissa axis and time values (t) given along the ordinate axis have been normalised by the period of wake passing ($\tau$) over the aerofoil.

The particular aerofoil, which has a circular leading edge, exhibits a strong unsteady interaction at the leading edge with the incoming wake. As described previously, in steady flow the early suction surface boundary layer would be expected to be laminar. With the incoming wake this is still the case, but it is thickened as the wake impinges onto the leading edge. The thickened laminar boundary layer quickly undergoes transition to turbulent—even before peak Mach number—which is quite different from steady flow. The turbulent patch propagates along the suction surface with the front of travelling at about 0.7V and the rear at about 0.5V, where V is the freestream velocity at the edge of the boundary layer. Thus in the time-space diagram it is seen to widen as it moves along the suction surface. Wheeler et al. describe this region as "old turbulence", since it is initiated by the wake at the leading edge.

This region of old turbulence is differentiated into two parts: there is a thickened boundary layer structure (B) that propagates at the front of this turbulent region with the rear of this structure is shown travelling at 0.6V, and behind region B there is a more conventional turbulent boundary layer.

Behind the old turbulence, at least on the early part of the suction surface, a "calmed" region forms which is relatively thinner and similar to the (steady) flow laminar region. Neither of these persist much beyond mid perimeter as they undergo transition to turbulent. Wheeler et al. call this "new turbulence".

Practically, the boundary layer at the trailing edge is dominated by the old turbulence. The thickness fluctuates periodically and is greater than that which would be seen in steady flow—for which reason the aerofoil loss is correspondingly elevated above the steady flow value.

STATEMENTS OF INVENTION

According to a first aspect of the present invention there is provided a turbine engine compressor aerofoil comprising a suction surface and a pressure surface with a thickness distribution defined therebetween, the aerofoil further comprising a first local maximum in the thickness distribution and a second local maximum in the thickness distribution, the second local maximum being downstream of the first local maximum and a first region of concave curvature in the suction surface between the first and second local maxima, wherein the second local maximum is disposed such that in use a boundary layer upstream of the second local maximum on the suction surface is thinned by the second local maximum.

The boundary layer may be sufficiently thinned so that an interaction of an upstream flow feature with the thinned boundary layer is capable of generating a turbulent spot with a calmed region downstream of the turbulent spot.

The second local maximum may be disposed such that in use a substantially turbulent boundary layer upstream of the second local maximum on the suction surface may be relaminarised near to and upstream of the second local maximum. The upstream flow feature may be an unsteady flow feature and may be one or more of: a wake from an upstream aerofoil; and a vortical structure emanating from a leading edge of the aerofoil. The calmed region may have a full velocity profile resembling that of a laminar boundary layer. The calmed region may be substantially laminar.

The first local maximum in the thickness distribution may be between a leading edge of the aerofoil and a mid point in the aerofoil chord. The second local maximum in the thickness distribution may be between a mid point in the aerofoil chord and a trailing edge of the aerofoil. The second local maximum in the thickness distribution may be disposed at a point in the rear third of the aerofoil chord.

The second local maximum may be at a point approximately 75% of the aerofoil chord from the leading edge. Alternatively, the second local maximum may be at a point approximately 85% of the aerofoil chord from the leading edge. Furthermore, the second local maximum may be at a point approximately 67% of the aerofoil chord from the leading edge and the third local maximum may be at a point approximately 85% of the aerofoil chord from the leading edge.

The aerofoil may further comprise a second region of concave curvature in the suction surface and the second region of concave curvature may be downstream of the second local thickness maximum.

The aerofoil may further comprise a third local maximum and the third local maximum may be downstream of the second local maximum. The aerofoil may further comprise a third region of concave curvature in the suction surface and the third region of concave curvature may be downstream of the third local maximum.

The first, second or third local maximum may be the overall maximum of the thickness distribution.

The acceleration parameter near to and upstream of the second local maximum in the thickness distribution may exceed a value in the range of $3.0\times10^{-6}$ to $3.5\times10^{-6}$. The acceleration parameter near to and upstream of the third local maximum in the thickness distribution may exceed a value in the range of $3.0\times10^{-6}$ to $3.5\times10^{-6}$. The "Acceleration Parameter" (K) is defined by:

$$K = \frac{v}{U_\infty^2} \cdot \frac{dU_\infty}{dx}$$

where v=kinematic viscosity $U_\infty$=local free stream velocity $dU_\infty/dx$=local freestream velocity gradient The variation in one or more of the first, second and third derivatives of the suction surface profile with respect to the axial chord may be continuous. The suction surface profile may comprise points of inflection between the first and second local maxima. The suction surface profile may comprise a point of inflection between the second local maximum and a trailing edge of the aerofoil. The suction surface profile may comprise points of inflection between the second and third local maxima. The suction surface profile may comprise a point of inflection between third local maximum and a trailing edge of the aerofoil.

According to a second aspect of the present invention there is provided a compressor comprising an aerofoil, the aerofoil comprising a suction surface and a pressure surface with a thickness distribution defined therebetween, the aerofoil further comprising a first local maximum in the thickness distribution and a second local maximum in the thickness distribution, the second local maximum being downstream of the first local maximum and the second local maxima being formed by a first region of concave curvature in the suction surface between the first and second local maxima, wherein the second local maximum is disposed such that in use a boundary layer upstream of the second local maximum on the suction surface is thinned by the second local maximum, the boundary layer being sufficiently thinned so that an interaction of an upstream flow feature with the thinned boundary layer is capable of generating a turbulent spot with a calmed region downstream of the turbulent spot.

According to a third aspect of the present invention there is provided a gas turbine comprising an aerofoil, the aerofoil comprising a suction surface and a pressure surface with a thickness distribution defined therebetween, the aerofoil further comprising a first local maximum in the thickness distribution and a second local maximum in the thickness distribution, the second local maximum being downstream of the first local maximum and the second local maxima being formed by a first region of concave curvature in the suction surface between the first and second local maxima, wherein the second local maximum is disposed such that in use a boundary layer upstream of the second local maximum on the suction surface is thinned by the second local maximum, the boundary layer being sufficiently thinned so that an interaction of an upstream flow feature with the thinned boundary layer is capable of generating a turbulent spot with a calmed region downstream of the turbulent spot.

According to a fourth aspect of the present invention there is provided an aerofoil for a compressor comprising a suction surface and a pressure surface with a thickness distribution defined therebetween, the aerofoil further comprising a first local maximum in the thickness distribution and a second local maximum in the thickness distribution, the second local maximum being downstream of the first local maximum and the first and second local maxima being formed by a first region of concave curvature in the suction surface between the first and second local maxima, wherein the second local maximum is disposed such that in use a substantially turbulent boundary layer upstream of the second local maximum on the suction surface may be relaminarised near to and upstream of the second local maximum.

According to a fifth aspect of the present invention there is provided a method of improving the efficiency of an aerofoil for a compressor, the method comprising: forming a surface feature on a suction surface of the aerofoil to thin a boundary layer on the suction surface of the aerofoil; and positioning the surface feature on the suction surface so as to allow an upstream flow feature to interact with the thinned boundary layer on the suction surface of the aerofoil, thereby generating a turbulent spot with a calmed region downstream of the turbulent spot.

According to a further aspect of the present invention there is provided a turbine engine compressor aerofoil comprising a leading edge, a trailing edge, a suction surface and a pressure surface between the leading edge and the trailing edge with a thickness defined therebetween, the aerofoil further comprising in a range of the span of the aerofoil a local maximum in the thickness distribution disposed before the mid point of the aerofoil chord, the suction surface having a primary region of concave curvature in the suction surface aft of the local maximum and the pressure surface having a primary region of convex curvature aft of the local maximum, wherein the thickness falls monotonically along the chord from the local maximum to the trailing edge.

The method may further comprise: providing a thickness distribution between the suction surface and a pressure surface of the aerofoil; and/or providing a first local maximum in the thickness distribution and a second local maximum in the thickness distribution, the second local maximum being downstream of the first local maximum. The first and second local maxima may be formed by a first region of concave curvature in the suction surface between the first and second local maxima. The second local maximum may correspond to the surface feature and may be disposed such that in use the boundary layer upstream of the second local maximum on the suction surface may be thinned by the second local maximum.

The upstream flow feature may be an unsteady flow feature and may be one or more of: a wake from an upstream aerofoil; and a vortical structure emanating from a leading edge of the aerofoil. The calmed region may have a full velocity profile resembling that of a laminar boundary layer. The calmed region may be substantially laminar.

LIST OF FIGURES

For a better understanding of the present invention, and to show more clearly how it may be carried into effect, reference will now be made, by way of example, to the accompanying drawings, in which:—

Figure 27:
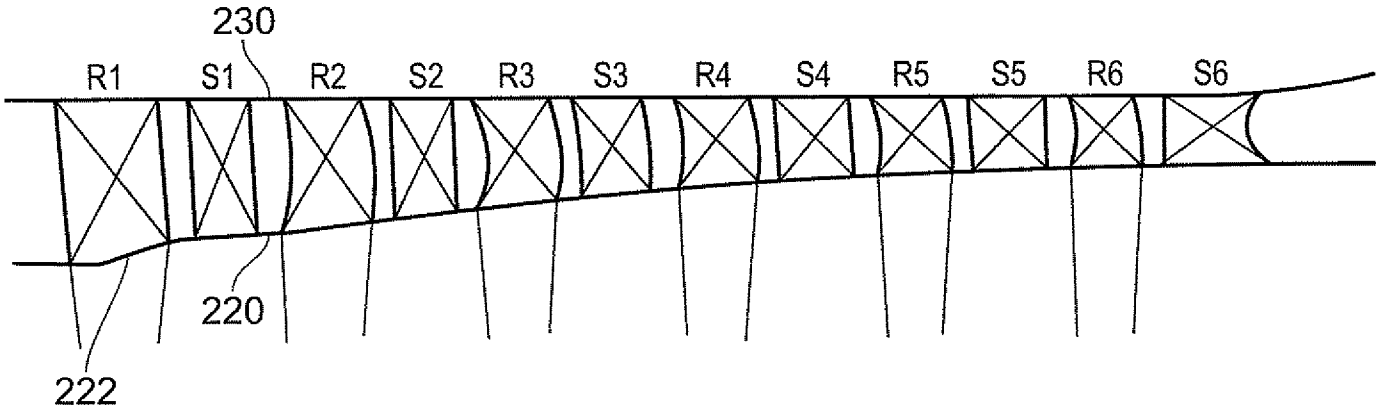
FIG. 27 is a meridonal view of a six stage high pressure compressor.

FIGS. 32(*a*) and 32(*b*) are the rotor 6 exit flow profiles of the High Pressure Compressor of FIG. 27 at the design speed near surge point.

DETAILED DESCRIPTION

Figure 4:
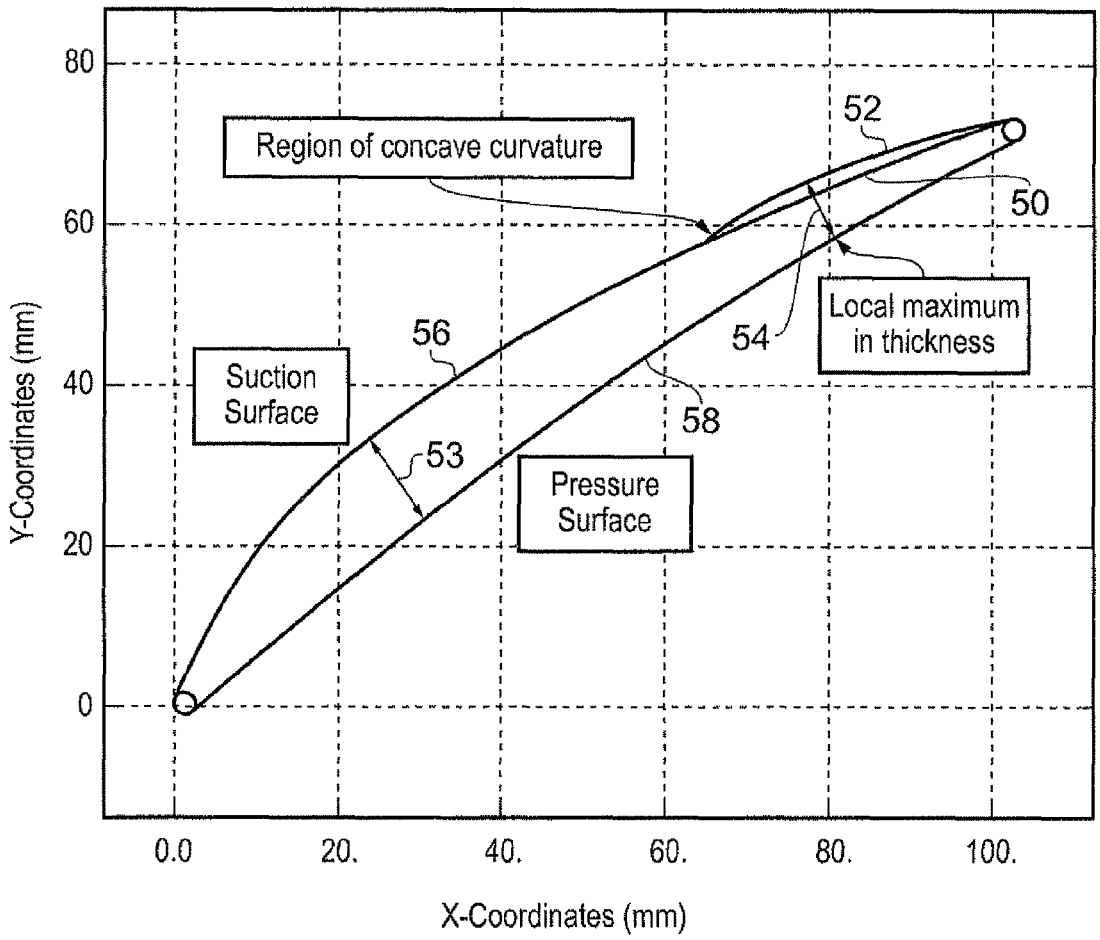
FIG. 4 is a comparison of a datum aerofoil section vs. the first embodiment.

FIG. 4 shows a low speed research compressor aerofoil and compares a conventional "datum" aerofoil shape 50 with an aerofoil shape 52 according to a first embodiment of the invention. Both aerofoils feature a local maximum 53 of the thickness distribution along the aerofoil chord in the front half of the aerofoil. In the case of a previously-proposed aerofoil, this is the maximum thickness.

For the first embodiment of this invention there is an additional local maximum in the thickness distribution 54, which is located in the rear half of the aerofoil chord. In the aerofoil shown in FIG. 4 this is located at about 75% chord. This additional thickening may be seen as producing a "bump" in the aerofoil suction surface 56. The pressure surface 58 is without any such "bumps". A smooth surface is maintained on the suction surface and this embodiment of the invention does not feature a discontinuity in the surface.

A conventional aerofoil typically has only convex curvature along its suction surface between the leading and trailing edges. With the first embodiment there is a region of concave curvature lying upstream of the additional maximum in the thickness distribution 54. To provide a continuous surface there must then be points of inflection at each end of this concave region. In the first embodiment there is no corresponding point of concave curvature on the downstream side of the additional thickening.

Figure 5:
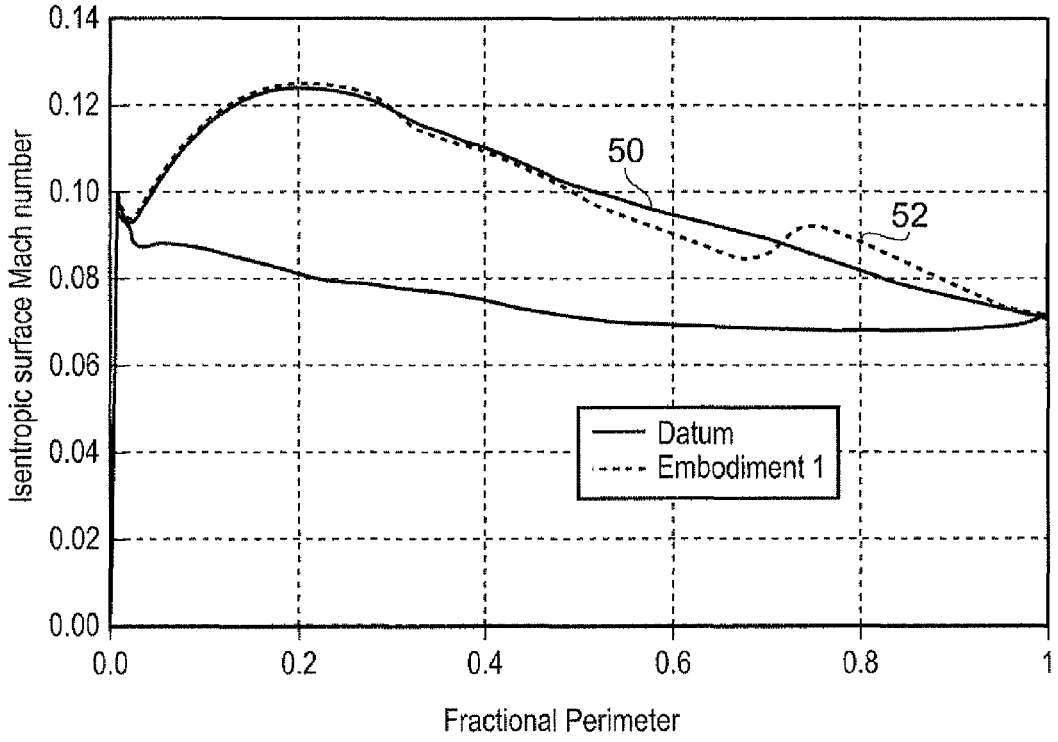
FIG. 5 is a comparison of aerofoil isentropic surface Mach number distributions, at design flow conditions for a datum aerofoil and embodiment 1.

The effect on the surface Mach number distribution is shown in FIG. 5. This plots isentropic surface Mach number (along the ordinate) against fractional perimeter (along the abscissa) for the datum profile 50 and the first embodiment 52. These curves have been calculated using a steady flow Computational Fluid Dynamics tool at the aerofoil design flow conditions. (This features a coupled calculation between an inviscid but compressible free stream flow and a sophisticated boundary layer method which can model separation and/or transition.) For the conventional shape the flow diffuses on the suction surface from the point of maximum thickness, around 22% perimeter, to the trailing edge. The boundary layer undergoes transition from laminar to turbulent after about 32% perimeter and at 66% perimeter is fully turbulent.

In the first embodiment 52 of the invention the local radii of curvature of the suction surface between about 66% to 75% perimeter induces acceleration or re-acceleration of the suction surface flow to provide a local peak in the suction surface flow Mach number at about 75% perimeter. Downstream of the peak there is diffusion to the trailing edge value. The effect of the localised thickening is to increase the aerofoil lift in the rear portion of the aerofoil.

The acceleration acts to thin the turbulent boundary layer in this region. The thinned boundary layer is able to negotiate the subsequent diffusion gradient, which is much higher than that seen on the conventional aerofoil in this region. The mechanism can be considered to be analogous to that at the front of the aerofoil, where a thin boundary layer is able to negotiate the strong diffusion after the peak Mach number point. Where the acceleration is particularly high the boundary layer may relaminarise. However, for a typical compressor operating in unsteady flow the boundary layer, although thinned, will remain turbulent.

Figure 6:
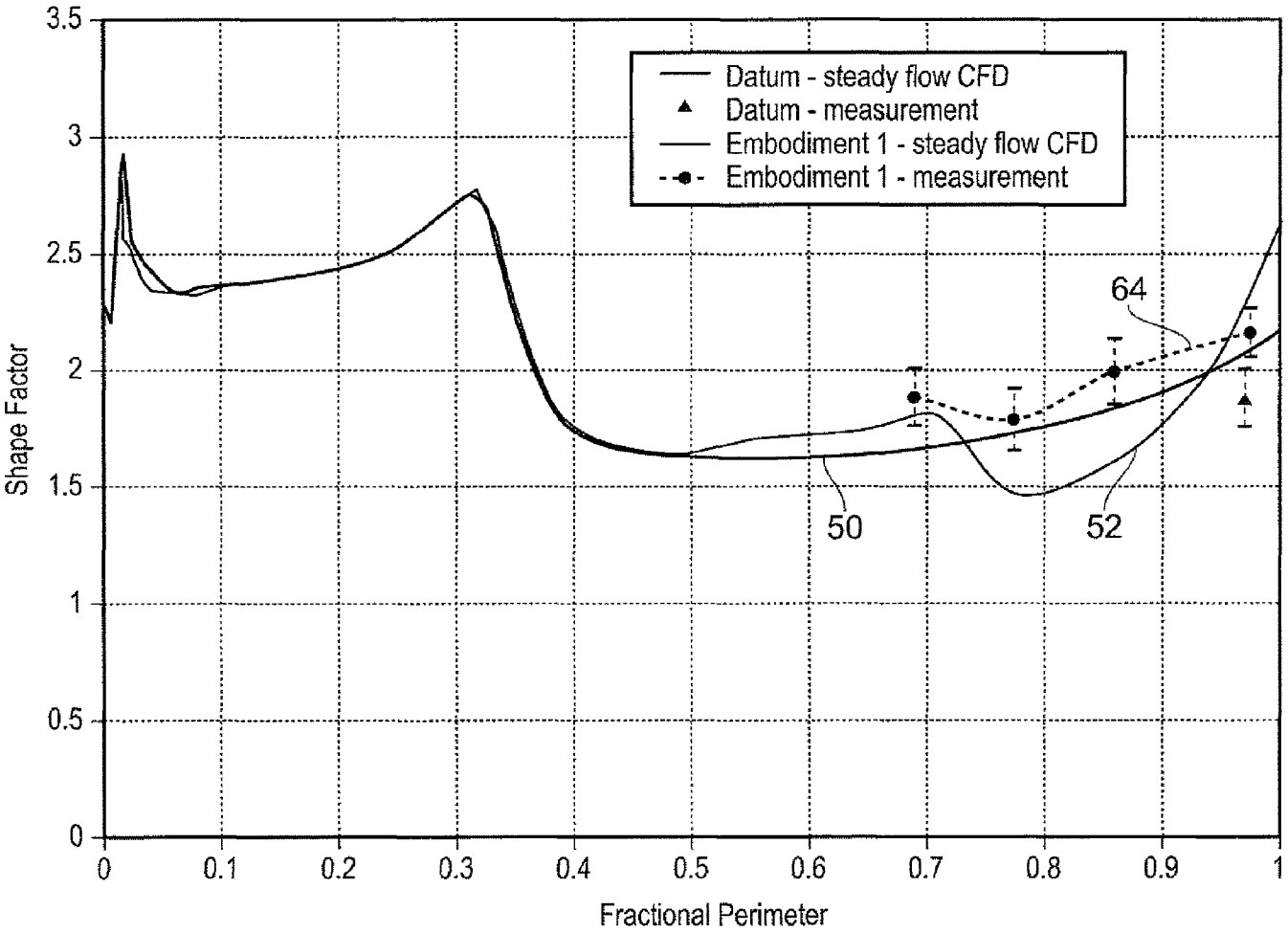
FIG. 6 shows the shape factor vs fractional perimeter for the suction surfaces of the datum aerofoil and embodiment 1.
Figure 7:
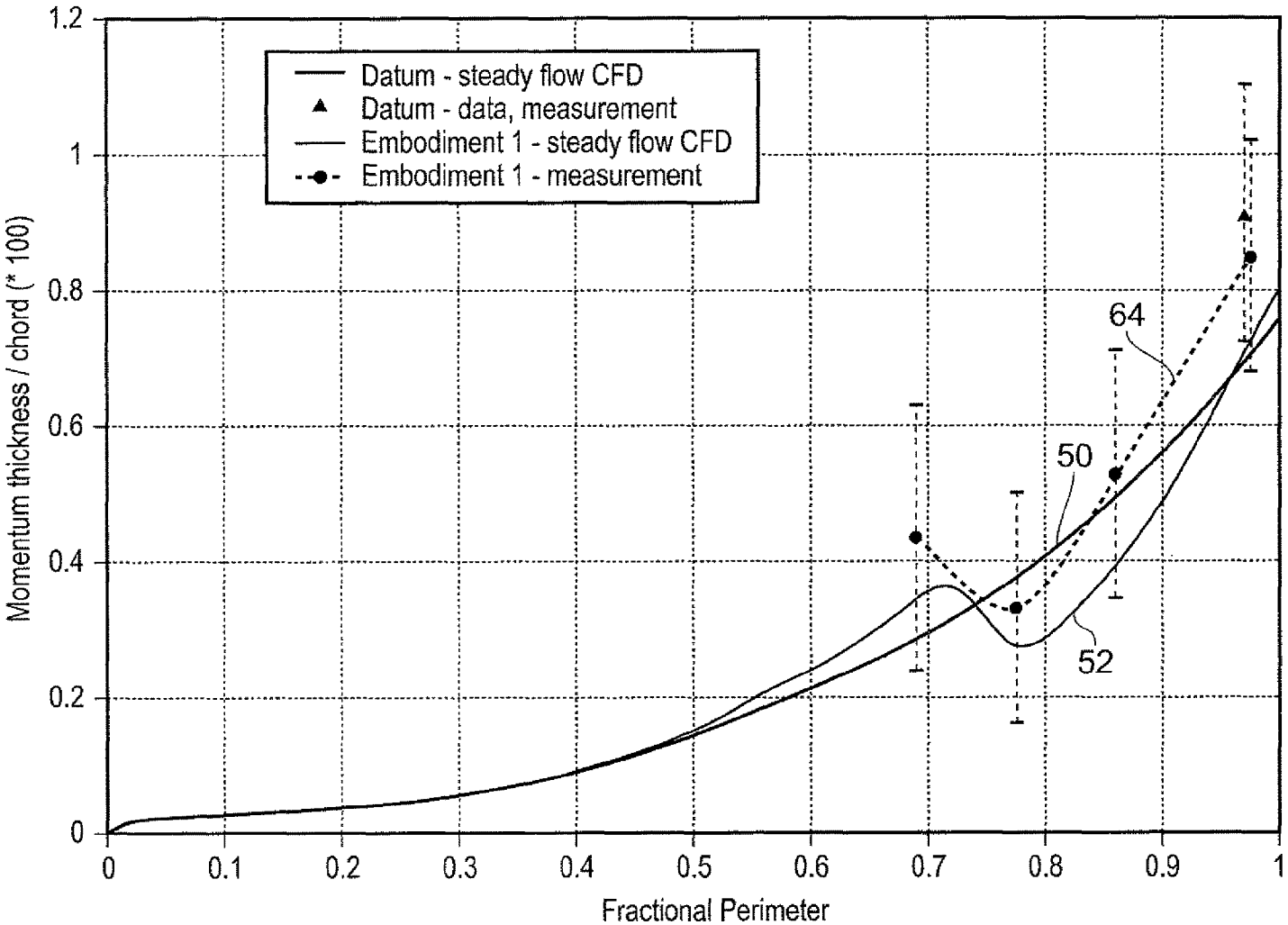
FIG. 7 shows the momentum thickness vs fractional perimeter for the suction surfaces of the datum aerofoil and embodiment 1.

FIGS. 6 and 7 plot the calculated and measured suction surface boundary layer behaviour using steady flow CFD for the mid height sections of the datum aerofoil 50 and of embodiment 1 52. FIG. 6 plots shape factor along the ordinate, while FIG. 7 plots the momentum thickness, normalised by the aerofoil chord, along it for the datum 50 and the aerofoil of the first embodiment 52. In both figures the abscissa is the fractional suction surface perimeter.

For both aerofoils the boundary layer is calculated to be laminar up to about 32% perimeter with the shape factor being between 2.3 and 2.8. After this, rapid transition to turbulent is calculated and the shape factor falls significantly, to around 1.6 as the boundary layer is in diffusing flow.

Over the localised thickening of the first embodiment between 0.7 and 0.75 perimeter the boundary layer is shown to be thinned relative to the datum as the shape factor falls. Beyond the maximum thickness at 0.75 perimeter the rate of boundary layer growth is greater than that of the datum due to the higher local diffusion gradient. The shape factor at the trailing edge for embodiment 1 is calculated to be significantly higher, and the momentum thickness slightly higher, than for the datum.

Time varying measurements have been made on both aerofoils and these are shown by plots 64 in FIGS. 6 and 7. The mean shape factors and momentum thicknesses taken from this data are plotted—together with the corresponding maximum and minimum values at these locations which are shown in the form of error bars on the mean. It can be seen that in the unsteady flow environment the boundary layers are thicker than calculated for steady flow. Importantly it can be seen that the boundary layer for embodiment 1 is no thicker at the trailing edge than for the datum aerofoil, thus indicating the aerodynamic loss is no worse.

Additionally the shape factors near the trailing edge for both aerofoils are lower than those calculated for steady flow. This means that the boundary layers have been made more stable by unsteady effects. For embodiment 1 the shape factor at the trailing edge is about the same as that calculated for the datum. This means that aerofoils can be designed in steady flow with higher trailing edge shape factors, as these will be reduced in the unsteady environment.

Figure 8:
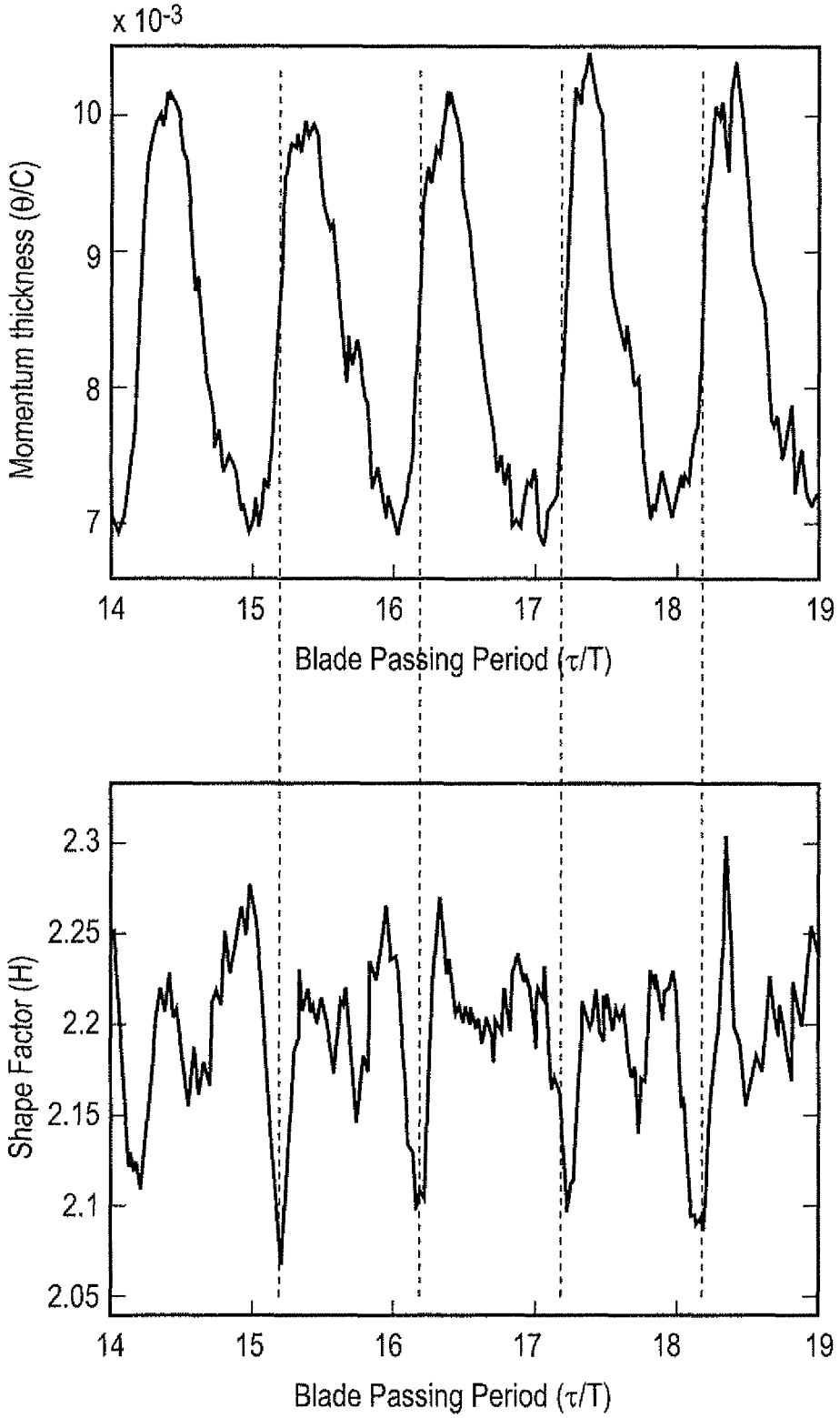
FIG. 8 depicts the time histories at the near trailing edge location for the suction surface of embodiment 1.

The plots of FIG. 8 depict the time histories at the near trailing edge location i.e. 97.5% perimeter for the measured shape factor and non-dimensionalised momentum thickness for the blade of embodiment 1. There are large periodic fluctuations in both the boundary layer thickness and shape factor, which are highly correlated. The momentum thickness rises as the front of the old turbulence region passes this point on the suction surface. As it does so the shape factor falls to its lowest level. The front of the thickened turbulent boundary layer is highly energetic with a relatively full boundary profile which increases the loss, since the boundary layer is thickened, but also makes it relatively stable. Accordingly, the average boundary layer shape factor at the trailing edge is reduced, and as already noted is lower than that expected from steady flow analysis. This mechanism is of particular use in stabilising the steady flow boundary layer where it would otherwise be in danger of separating.

Figure 1:
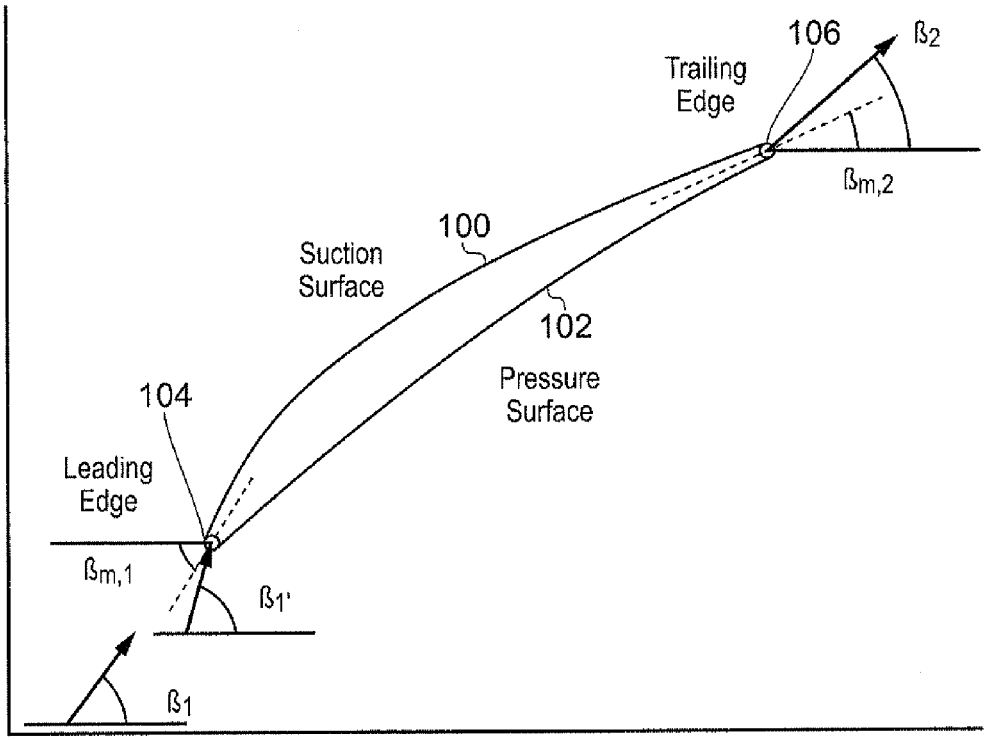
FIG. 1 is an illustration of a typical prior art compressor blade
Figure 2:
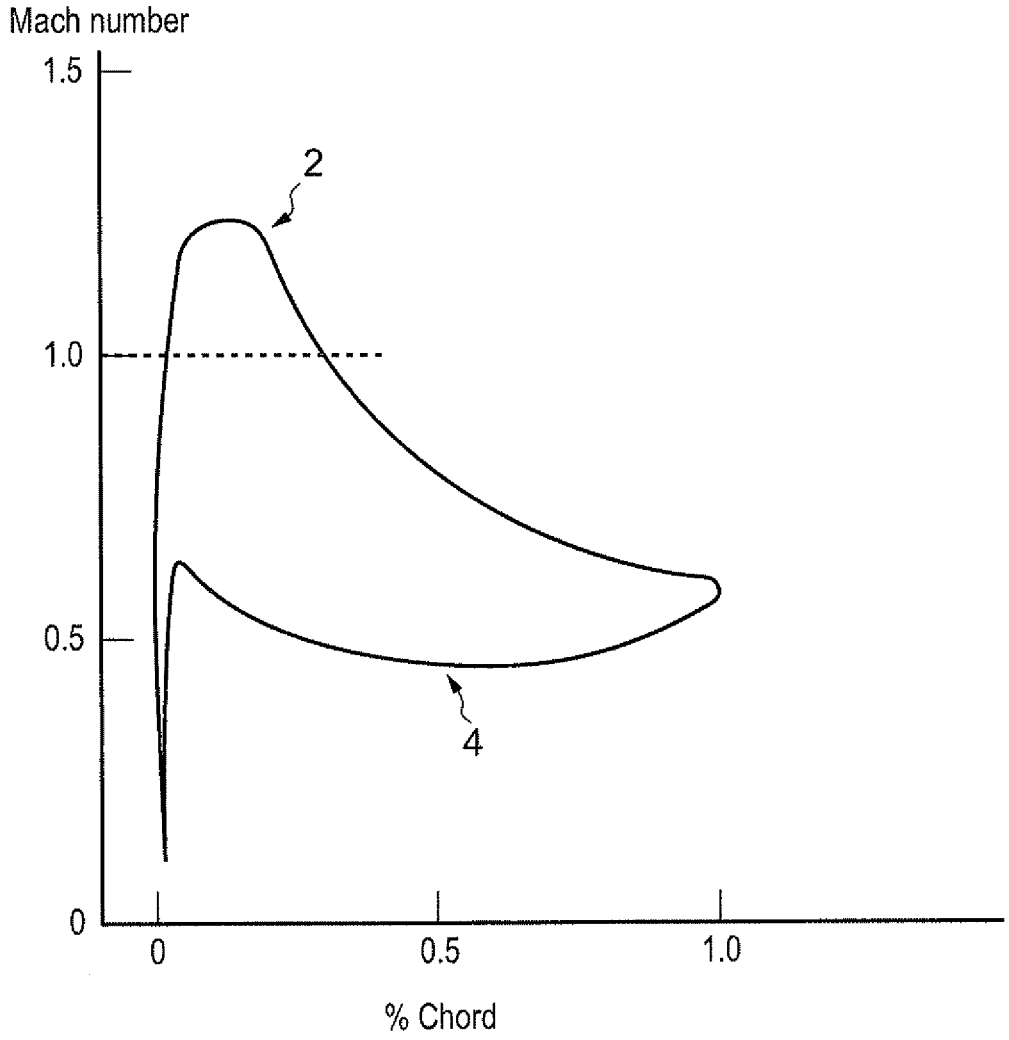
FIG. 2 is a schematic representation of design Mach number distribution of a supercritical (controlled diffusion) compressor aerofoil.
Figure 3:
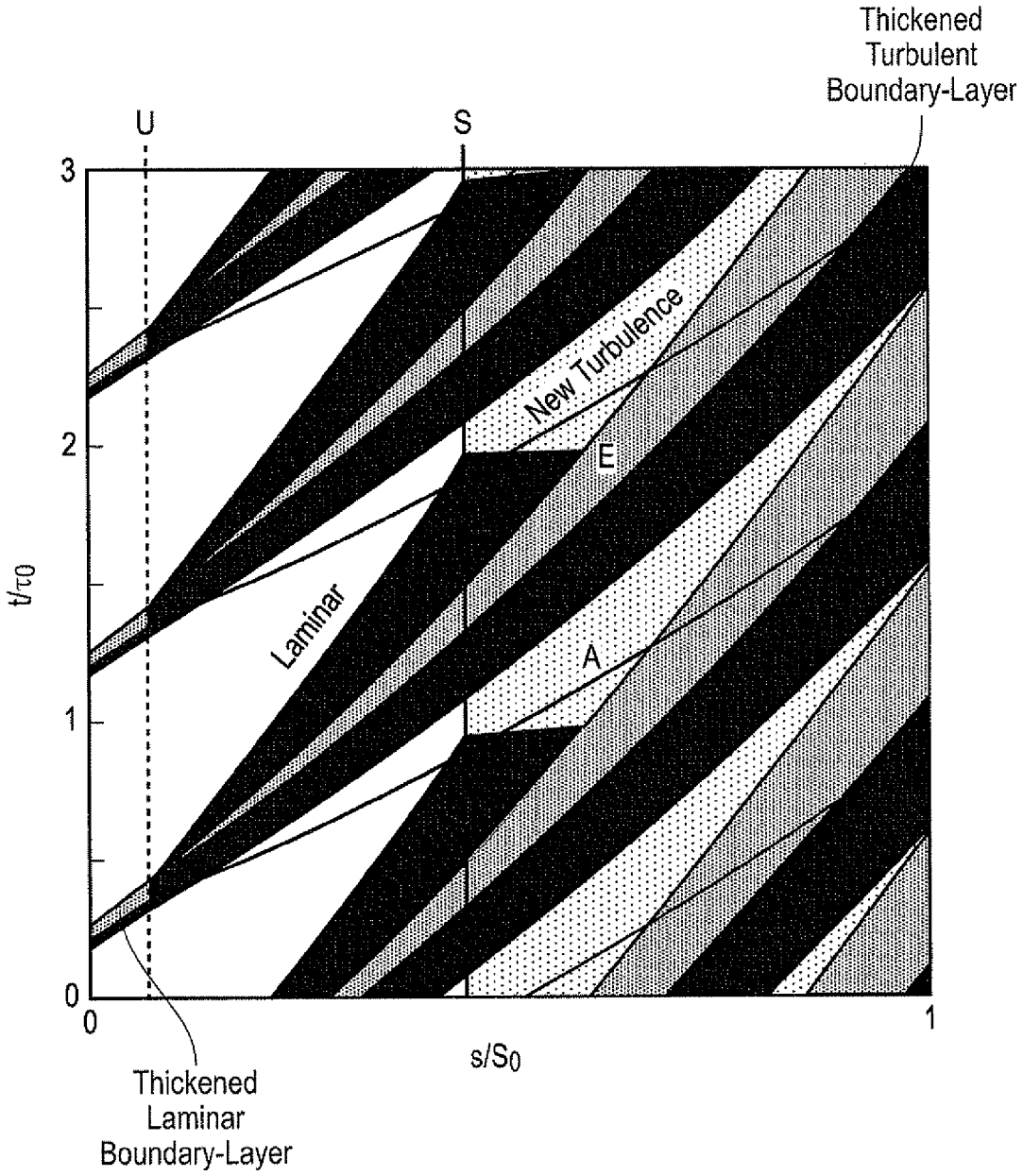
FIG. 3 is an illustration of a time-space diagram for a compressor stator aerofoil mid-height section from Wheeler et al. ASME GT, 2006-9092.

The present invention thus exhibits several advantages and these are summarised below:

1. The aerofoil is thickened relative to conventional designs and the cross-sectional area increased thus making the aerofoil mechanically stronger, and in what is typically the thinnest (and thus weakest) portion of the aerofoil. For conventional blading, if the cross-sectional area has to be increased to improve the mechanically integrity, then this would be done by increasing the maximum thickness (in the front part of the aerofoil chord). Increasing what is known as the "thickness/chord" ratio of a conventional aerofoil results in increased profile losses. This invention allows the aerofoil to be strengthened without this aerodynamic penalty (of thickening in the front portion of the aerofoil). In some circumstances the extra cross-sectional area in the rear portion of the aerofoil may allow the thickness at the front to be reduced, resulting in a further reduction in aerodynamic loss. For most blade rows, whether stators or rotors, the strengthening effect will be greatest in the case where the thickening runs along the whole span of the aerofoil—starting from the end (or ends) where the aerofoil is fixed (which may be the hub and/or the casing).
2. The aerodynamics of the aerofoil suction surface are so controlled that the turning of the flow achieved by the aerofoil may be increased, and thereby also the diffusion of the flow across the compressor row, without incurring extra losses at the design flow condition.
3. The invention acts to improve the off-design performance of the aerofoil. Since a compressor has to operate over a wide range of conditions—especially a multi-stage compressor in an aero engine—it is vital that the aerofoils in such a machine be able to tolerate a certain range of variation in the inlet flow angle without breakdown (typically gross boundary layer separation) of the flow on either of the surfaces. The invention acts to increase the range of inlet flow angles that the aerofoil can tolerate before experiencing such breakdown of the flow. As a result the surge margin of the compressor may be increased.
4. The additional aerodynamic loading in the rear part of the aerofoil may also act to reduce "secondary losses" in the aerofoil passage. These arise from over turning of the end wall boundary layer on either or both of the two end walls which roll up into vortical structures. These mix out to generate additional losses in themselves and cause non ideal flow conditions to be delivered to any downstream blade row, degrading its aerodynamic performance also. For conventional compressor aerofoils, such as described in FIG. 1, the forward loaded nature of the velocity distribution is known to exacerbate these effects. The invention described here, by moving some of the aerodynamic loading rearwards may act to reduce these secondary flows. This benefit will be enhanced in blade rows where the application of this invention allows the aerodynamic loading in the front part of the aerofoil to be reduced, by reducing the maximum thickness in the front half.
5. As already noted, compressors typically feature stages made up of rotor/stator pairs. Rotors are usually fixed at their hubs to a rotating drum, while stators are fixed to static casings at their outer extremities. It is a common feature in compressors to have aerofoils that are "shroudless". In the case of rotor blades this means that at their tips there is a clearance gap between the moving blades and the static casing. In the case of shroudless stators, there is a corresponding gap between the hub of the aerofoil sections and the moving rotor drum. In each case there is a leakage flow through the clearance gaps, from the pressure to the suction side of the aerofoils. This leakage flow degrades the aerodynamic performance of the compressor, both reducing aerodynamic efficiency and in some cases reducing surge margin. For conventional compressor aerofoils the forward loaded nature of the velocity distribution is known to exacerbate these effects. By moving some of the aerodynamic loading rearwards the effect of these clearance flows may be reduced. This benefit will be enhanced in blade rows where the application of this invention allows the aerodynamic loading in the front part of the aerofoil to be reduced, by reducing the maximum thickness in the front half.

Figure 9:
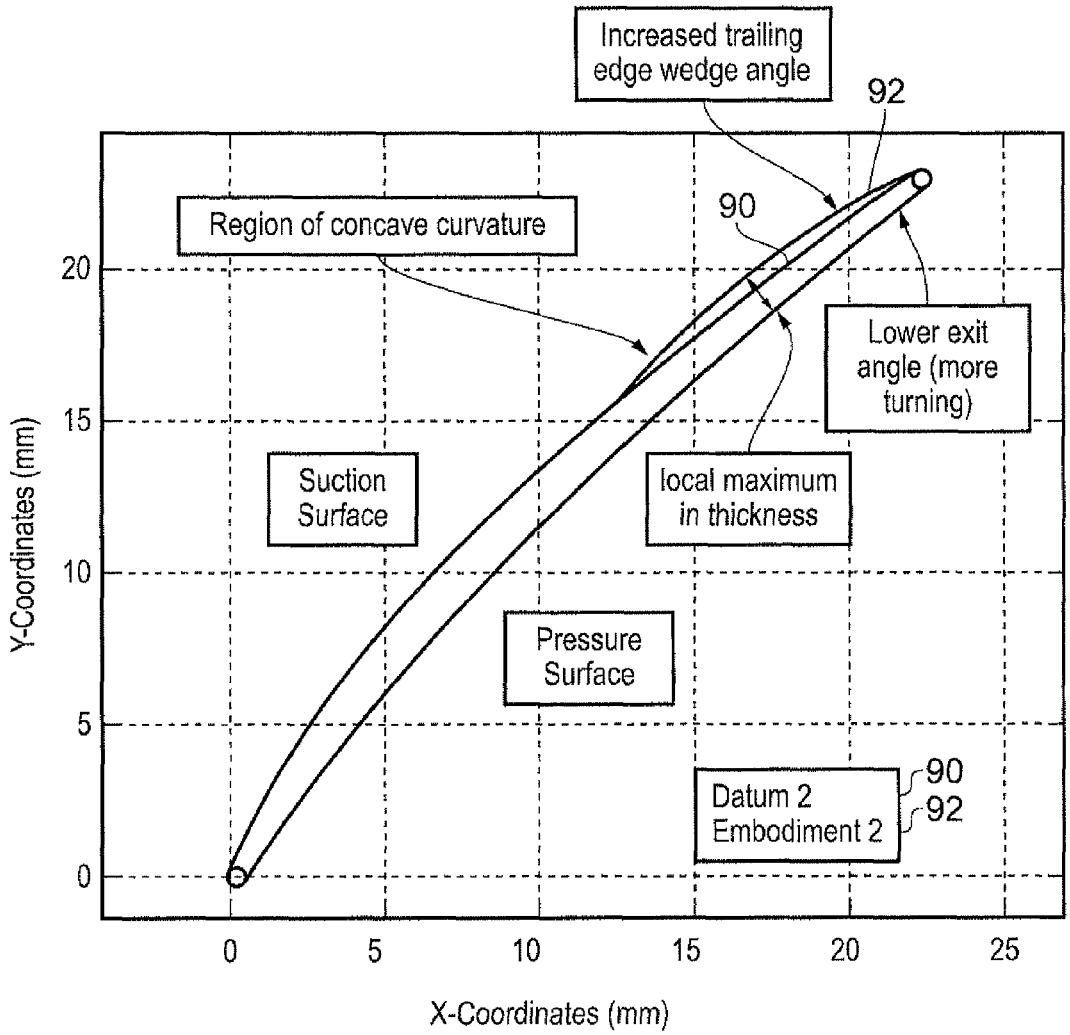
FIG. 9 is a comparison of aerofoil sections—datum profile vs. the second embodiment.

FIG. 9 shows a high speed, but still subsonic, compressor aerofoil and compares a conventional aerofoil shape 90, with one incorporating a second embodiment 92.

As with the first embodiment, both aerofoils feature a local maximum of the thickness distribution along the aerofoil chord in the front half of the aerofoil. There is again an additional local maximum in the thickness distribution, this time located in the rear half of the aerofoil chord. In the aerofoil of FIG. 9 this is located at about 70% chord.

A number of other features are similar to embodiment 1: the thickening produces a "bump" on the suction surface; a smooth surface is always maintained—there is no discontinuity in the surface; there is a region of concave curvature lying upstream of the additional maximum in the thickness distribution—but no corresponding point of concave curvature on the downstream side.

One difference between embodiments 1 and 2 may be found at their trailing edges. In embodiment 2 both the exit wedge angle, and thus the blade exit angle have been increased relative to the relevant conventional profile and in that of embodiment 1. The lower exit angle provides greater turning of the flow by the aerofoil and consequently more lift.

By offering an increased lift for each aerofoil in the row it is possible to reduce the number of blades in the compressor. In making these changes the blade count of embodiment 2 depicted in FIG. 9 has been reduced by 4.5% relative to a conventional aerofoil, by increasing the lift on each aerofoil in the row.

Figure 10:
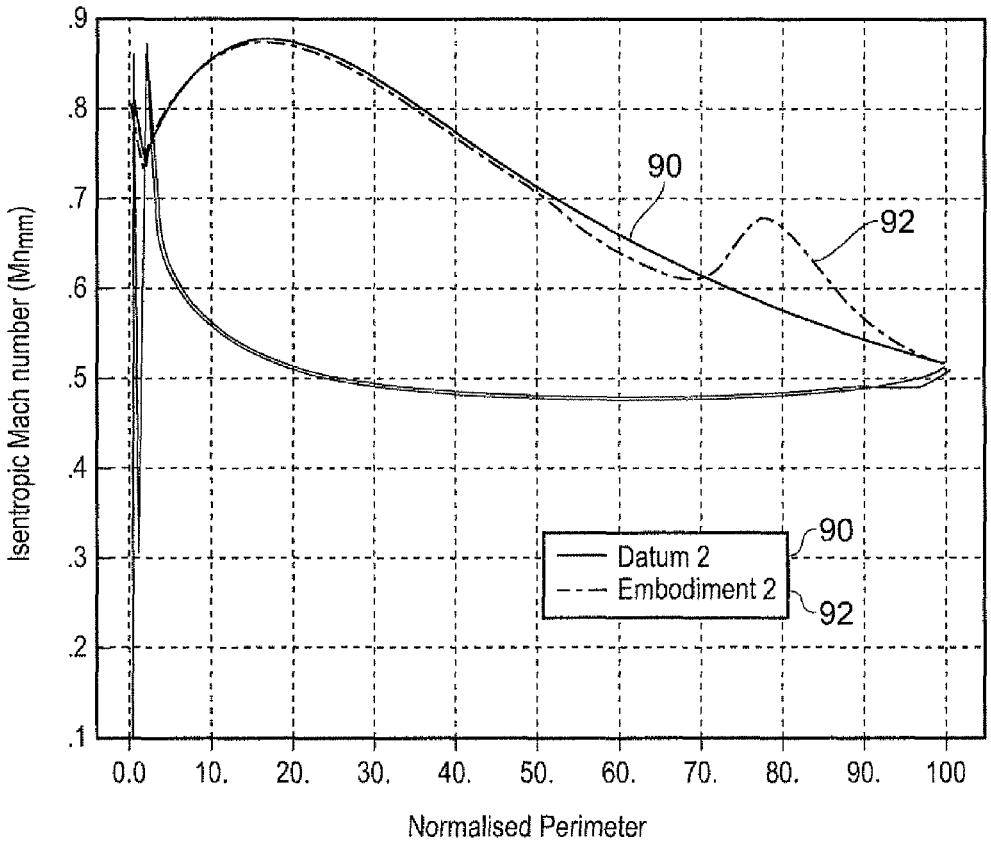
FIG. 10 is a comparison of aerofoil isentropic surface Mach number distributions, at design flow conditions for a conventional aerofoil and embodiment 2.

The effect on the surface Mach number distribution is shown in FIG. 10 which plots isentropic surface Mach number along the ordinate against fractional perimeter along the abscissa for the two profiles. These curves have been calculated using a steady flow Computational Fluid Dynamics tool at the aerofoil design flow conditions.

All the extra lift is in the rear part of the aerofoil, from about 63% chord to the trailing edge. Most of this extra lift is on the suction surface, but there is also a small increase in lift at the trailing edge on the pressure surface. The velocity distribution over the front 40% of the suction surface is largely unchanged.

This is an important effect of increasing the aerofoil lift by use of the bump on the late suction surface. As already mentioned when trying to increase the lift of a conventional aerofoil all of it will appear at the front of the aerofoil and the leading edge upwash is increased. The practical result for a conventional aerofoil would then be either reduced tolerance to positive incidence or more turning by the aerofoil (likely to increase loss). By putting all the extra lift in the rear portion of the aerofoil the upwash is not increased, and the incidence tolerance of the aerofoil can be maintained without changing the turning.

The turning in the aerofoil row has been increased by 0.3° in 15°—with the result that the exit Mach number from the row is lower, and the diffusion across the row has been increased.

Figure 11:
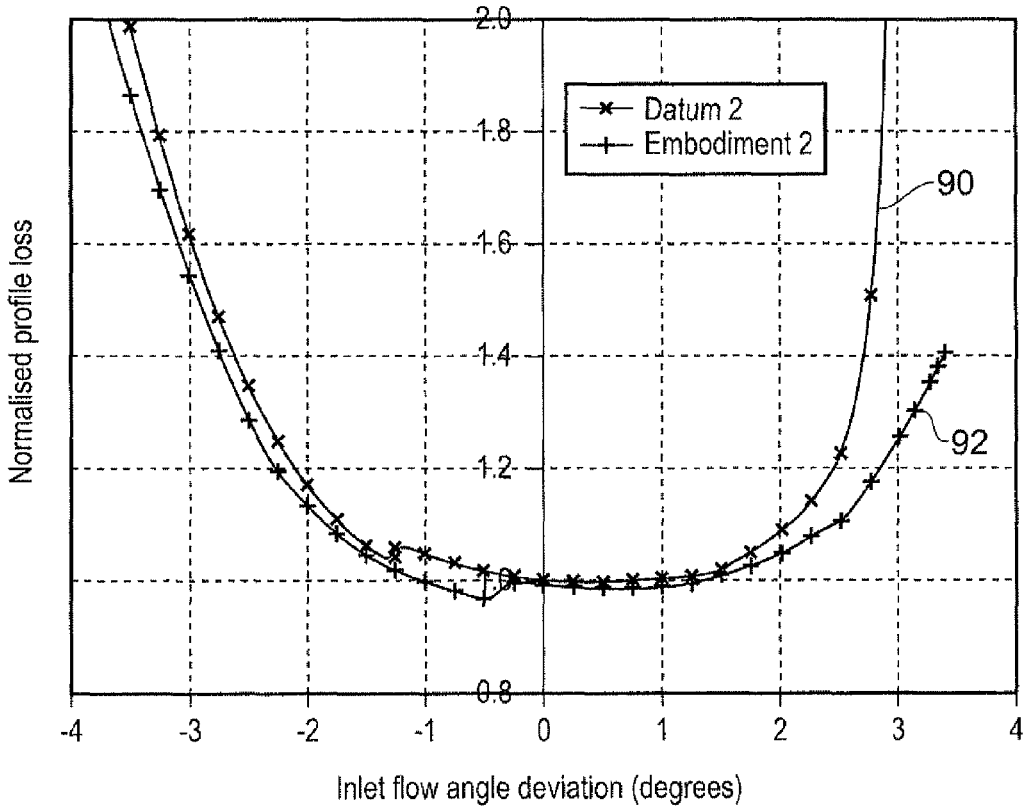
FIG. 11 shows the normalised profile loss vs inlet flow angle deviation for a conventional aerofoil and embodiment 2.

FIG. 11 plots the loss loops for embodiment 2 92 and datum 90 as loss normalised by the loss of datum at design flow conditions along the ordinate against the variation in inlet flow angle relative to design flow conditions along the abscissa.

As can be seen, the loss for embodiment 2 at the design condition is unchanged, while the loss loop is wider—at both positive and negative inlet angle deviations. This is of course from a steady flow calculation, but it is understood, from the experimental results obtained for embodiment 1, that this improvement in their relative behaviour will be retained in unsteady flow.

Further embodiments shown here have been applied to a "high-lift" compressor aerofoil, which features a 15% increase in pitch/chord ratio over a conventional aerofoil. (In this case the chord is largely unchanged and the increase in pitch/chord has been effected by reducing the aerofoil numbers in the row by 15%).

It is known that such "high-lift" aerofoils will have lower aerodynamic losses due to reduced "wetted area", at least at their design inlet flow angles. However, the higher loading typically reduces the range of inlet angle that they can operate over without breakdown of the flow. This may reduce the surge margin of the compressor to unacceptably low levels for safe, commercial use.

The useful operating range of an aerofoil, in terms of the allowable variation in inlet flow angle, is often described by reference to its "loss loop". This plots aerofoil loss against the inlet flow angle, more usually presented as the deviation of the flow angle from that at the aerofoil design condition.

Figure 12:
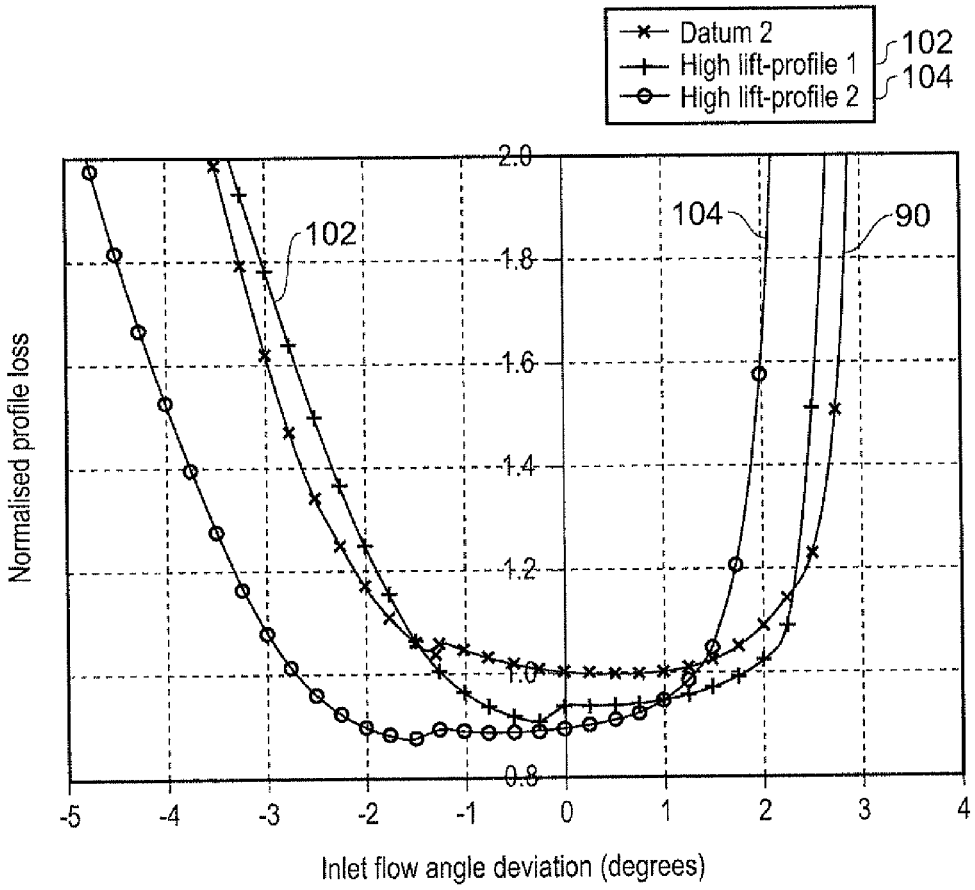
FIG. 12 is a comparison of loss loops for typical conventional and high lift aerofoils.

FIG. 12 plots loss (normalised by the loss of the conventional aerofoil at design flow conditions) along the ordinate against the variation in inlet flow angle (relative to design flow conditions) along the abscissa. The plot compares the loss loop for the conventional aerofoil datum 90 with two high lift variants of it 102, 104 (as calculated in steady flow conditions using CFD).

The following should be noted from FIGS. 11 and 12:

For the conventional lift aerofoil the operating range (using the previous definition of doubling the loss relative to the design condition) is about −3.5° to +2.9°.

The first high lift profile 102 has a slightly narrower loss loop, reduced by about 0.2° at each end of the range. For this aerofoil the blade inlet and exit angles are modified to compensate for the increased leading edge upwash and trailing edge deviation to achieve the same exit flow angle as that achieved by datum 2. At the design condition (zero inlet deviation) loss is reduced i.e. the reduced net "wetted area" of the aerofoil improves efficiency despite the higher loss per aerofoil. This may be of use to the aerodynamic designer, but it would always be desirable to have retained (or if possible improved) the original operating range.

The second high lift profile 104 demonstrates what happens if the inlet angle is not changed to compensate for the increased leading edge upwash. It is largely the same shape as the conventional profile 90, but with the 15% reduction in numbers. Only the exit blade angle has been changed—to achieve the required exit flow angle. The result in FIG. 12 is that the loss loop is now highly skewed. The operating range at positive inlet flow angle variation is reduced by almost 1°, while that at negative angles has been significantly increased. The leading edge of the blade is experiencing increased positive incidence, due to the increased loading of each individual aerofoil. Such an aerofoil would be of little commercial use, as the compressor surge margin would be much reduced.

The further embodiments discussed below act to improve the loss loop of the second high lift profile.

Figure 13:
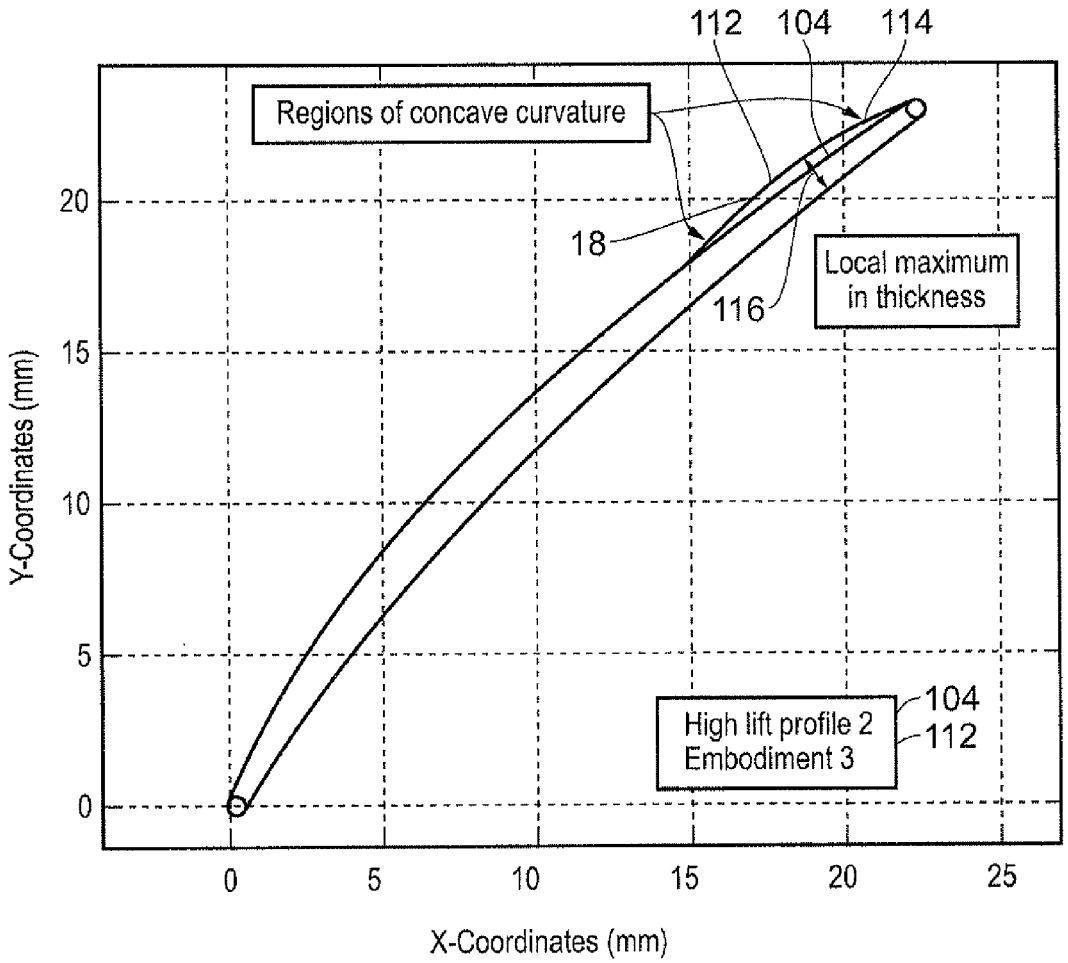
FIG. 13 is a comparison of high lift aerofoil sections—second high lift profile vs. the third embodiment.

FIG. 13 compares a third embodiment 112 with the second conventional high-lift aerofoil profile 104. The aerofoil thickness has been adjusted so that the maximum thickness of the aerofoil is in the rear half of the chord. In addition there is an additional region of concave curvature 114 on the suction surface now downstream of the rearmost local maximum in the thickness distribution 116. This is in addition to the region of concave curvature 118 upstream of the rearmost local maximum in the thickness distribution 116.

Figure 14:
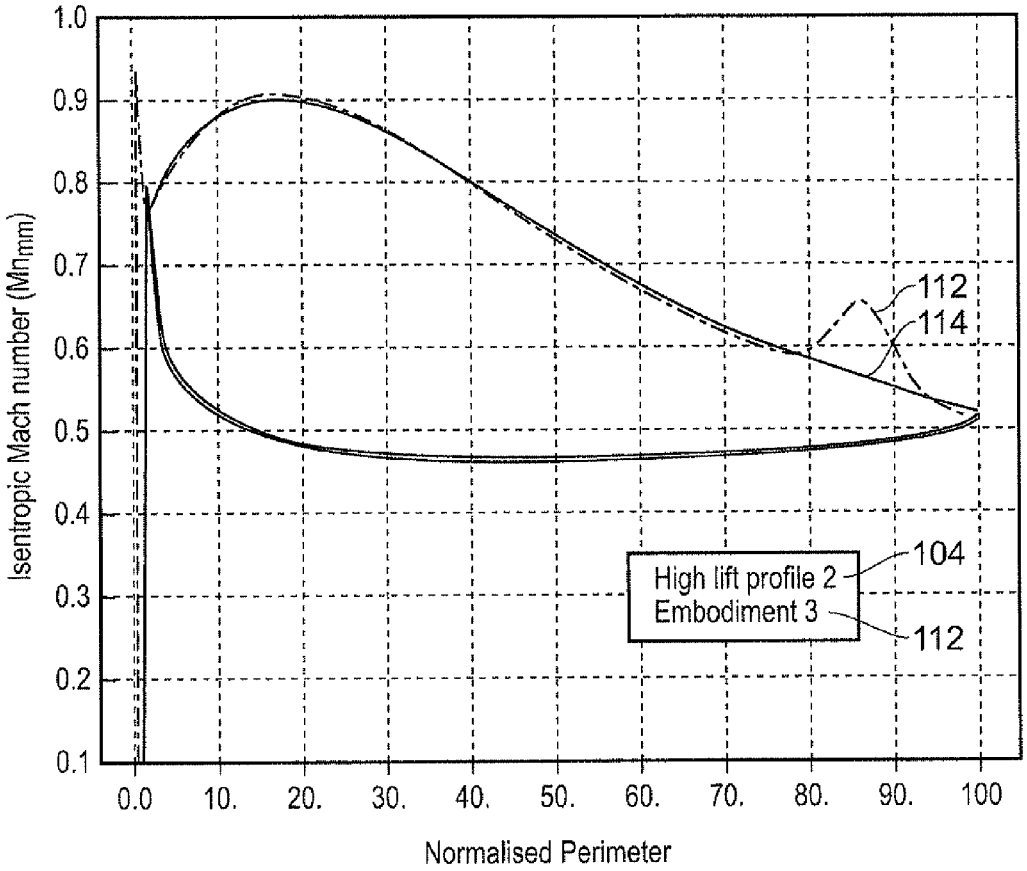
FIG. 14 is a comparison of aerofoil isentropic surface Mach number distributions, at design flow conditions—second high lift profile vs. the third embodiment.

FIG. 14 plots, for the second high lift profile 104 and the third embodiment 112 calculated steady flow isentropic surface Mach numbers (along the ordinate) against the % perimeter distance (abscissa). This shows the increased lift in the rear half of the aerofoil for the third embodiment.

Figure 15:
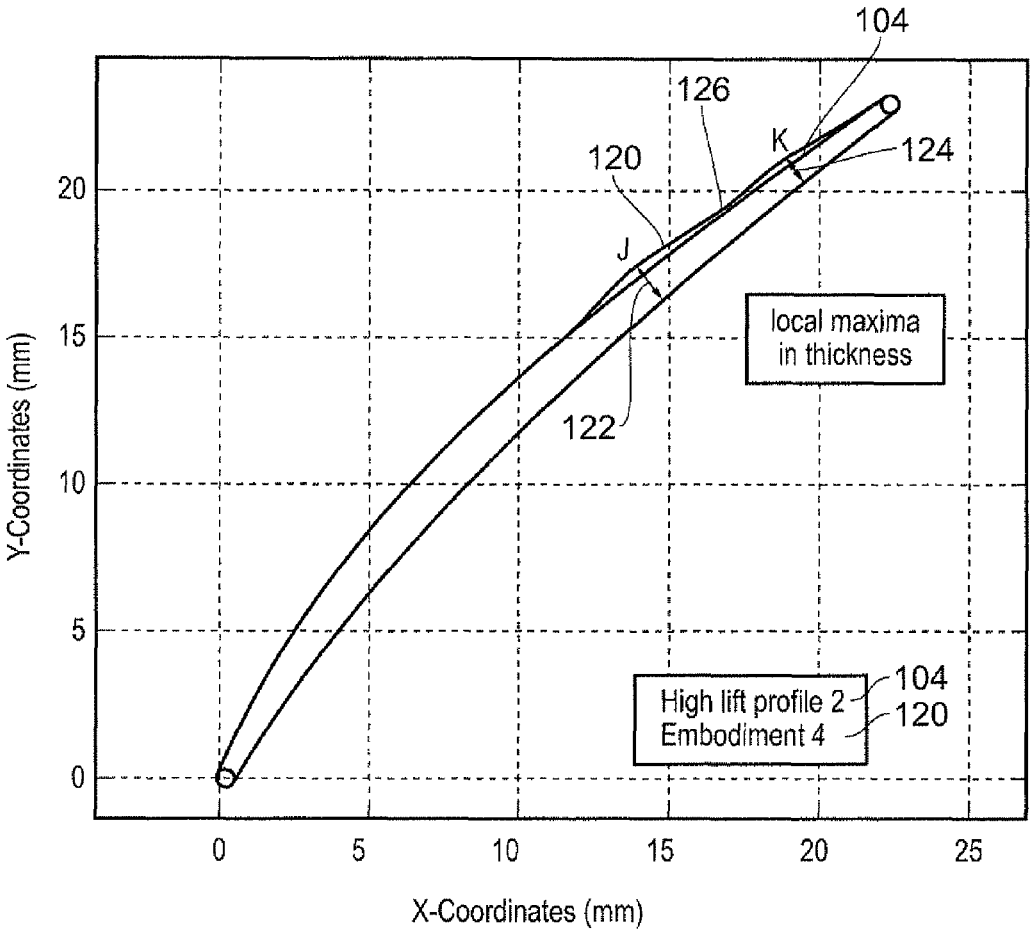
FIG. 15 is a comparison of high lift aerofoil sections—second high lift profile vs. the fourth embodiment.

FIG. 15 compares a fourth embodiment 120 to the "datum" second high lift profile 104. In the fourth embodiment, there is a third local maximum in the thickness distribution 124, in addition to the second local maximum 122, both of which are in the rear half of the aerofoil chord. The maximum thickness of the aerofoil in this case is at the second local thickness maximum 122. In the fourth embodiment there is a single region of concave curvature 126 between the second and third maximum 122, 124.

Figure 16:
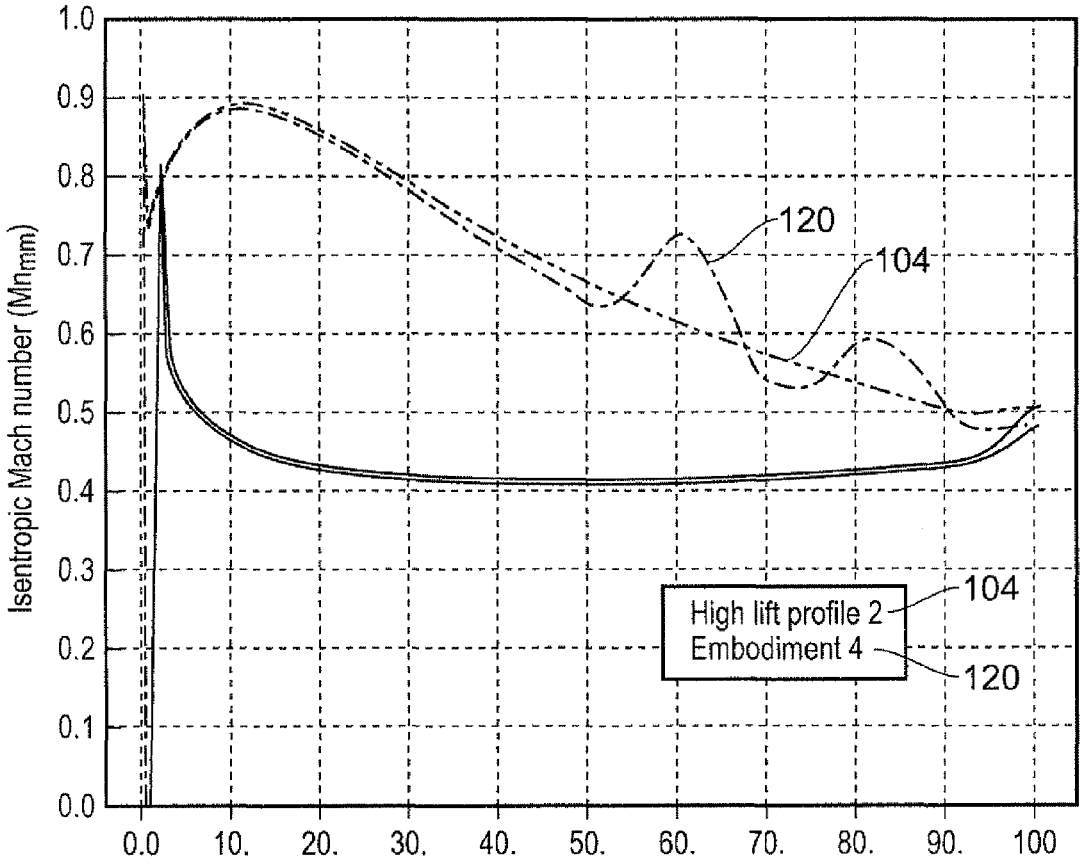
FIG. 16 is a comparison of isentropic mach number vs % axial chord of the second high lift profile and the fourth embodiment, at design flow conditions.

FIG. 16 plots, for the high lift profile 104 and the fourth embodiment 120, the calculated isentropic surface Mach numbers (along the ordinate) against the % perimeter distance (abscissa). Again this shows the increased lift in the rear half of the aerofoil for the fourth embodiment.

Figure 17:
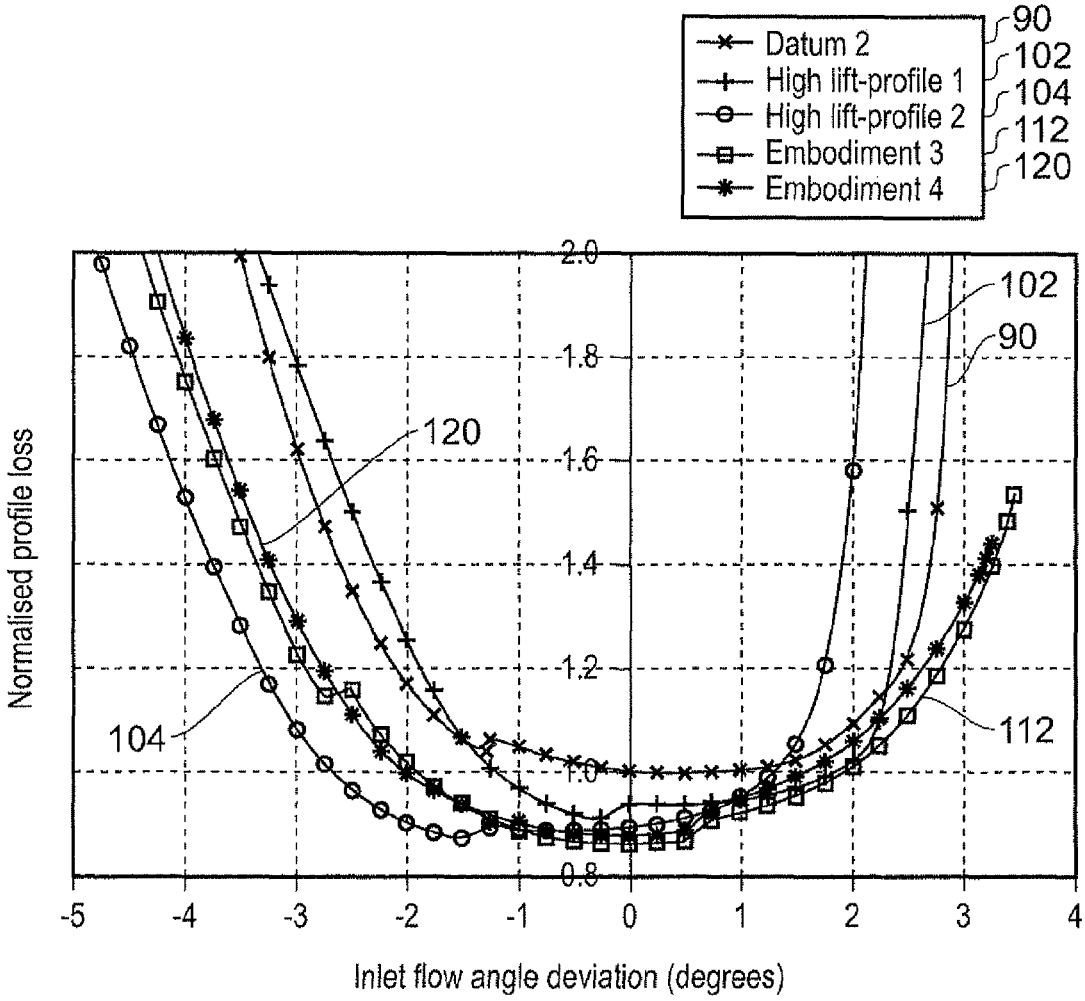
FIG. 17 is a comparison of normalised profile loss vs. inlet flow angle deviation for two high lift aerofoil profiles and the third and fourth embodiments.

FIG. 17 plots loss loops for the third and fourth embodiments against those already shown in FIG. 12, calculated in steady flow. All of these embodiments deliver wider loss loops than that taken from the conventional profile 90, most importantly increased tolerance to positive incidence. By placing the increased lift in the rear part of the aerofoil, again the need to modify the inlet angle to compensate for increased upwash has been mitigated. Embodiments 3 and 4 are able to achieve a loss reduction at the design condition of around 14% in steady flow.

As already noted, the extra cross-sectional area of these embodiments mechanically strengthens them relative to conventional aerofoils. Also the movement of aerodynamic loading rearwards may reduce the secondary flows and their associated losses, and also any hub or tip clearance losses.

It should be understood that a number of local maximum in the thickness distribution may be applied to the rear half of the aerofoil. These may or may not be thicker than the maximum thickness for a conventional aerofoil. Each local maximum will have region of concave curvature on its upstream side. Multiple maxima will have a region of concave curvature between them. The last thickness maximum may or may not have a region of concave curvature on its downstream side.

The peak Mach number over any of the additional thickness maximum will always be subsonic (below 1.0). Thus this invention could be applied to a supercritical aerofoil, but only in the later region of the suction surface that exhibited subsonic flow.

The positioning of the additional thickness maxima (or maximum if only one) will be determined by a number of factors, including: Reynolds number; wake passing frequency (from the upstream row); the aerodynamic loading of the aerofoil at its design point (defined by well known parameters such as Diffusion Factor, DeHaller number and static pressure rise coefficient) and the conventional geometric parameters (thickness/chord ratio, pitch/chord ratio and the minimum allowable absolute values of the maximum thickness and the leading and trailing edge thicknesses) as well as the leading edge shape.

The first (or only) additional thickness maximum will always be positioned in the rear half of the aerofoil chord. Where there is more than one additional thickness maximum, such as in embodiment 4, the distance between the extra maxima will be no more than 40% chord, and the last thickness maxima will be no more than one third chord from the trailing edge.

Figure 18:
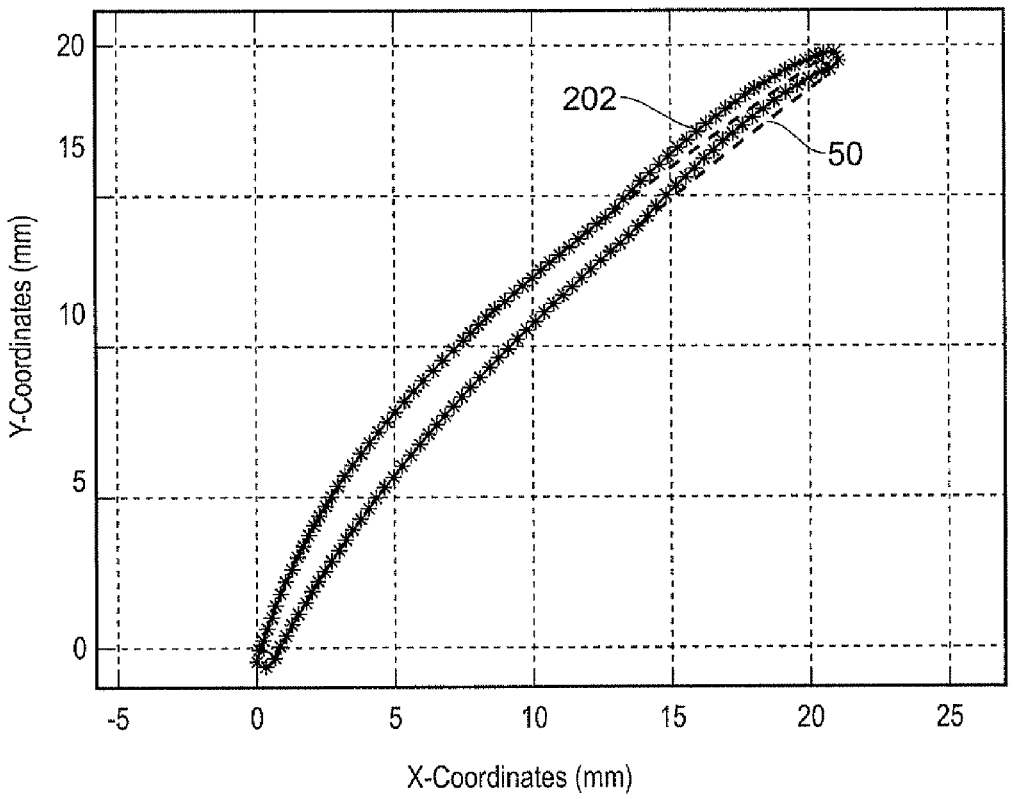
FIG. 18 is a comparison of aerofoil mid-height sections of a conventional high lift aerofoil and an alternative embodiment.
Figure 19:
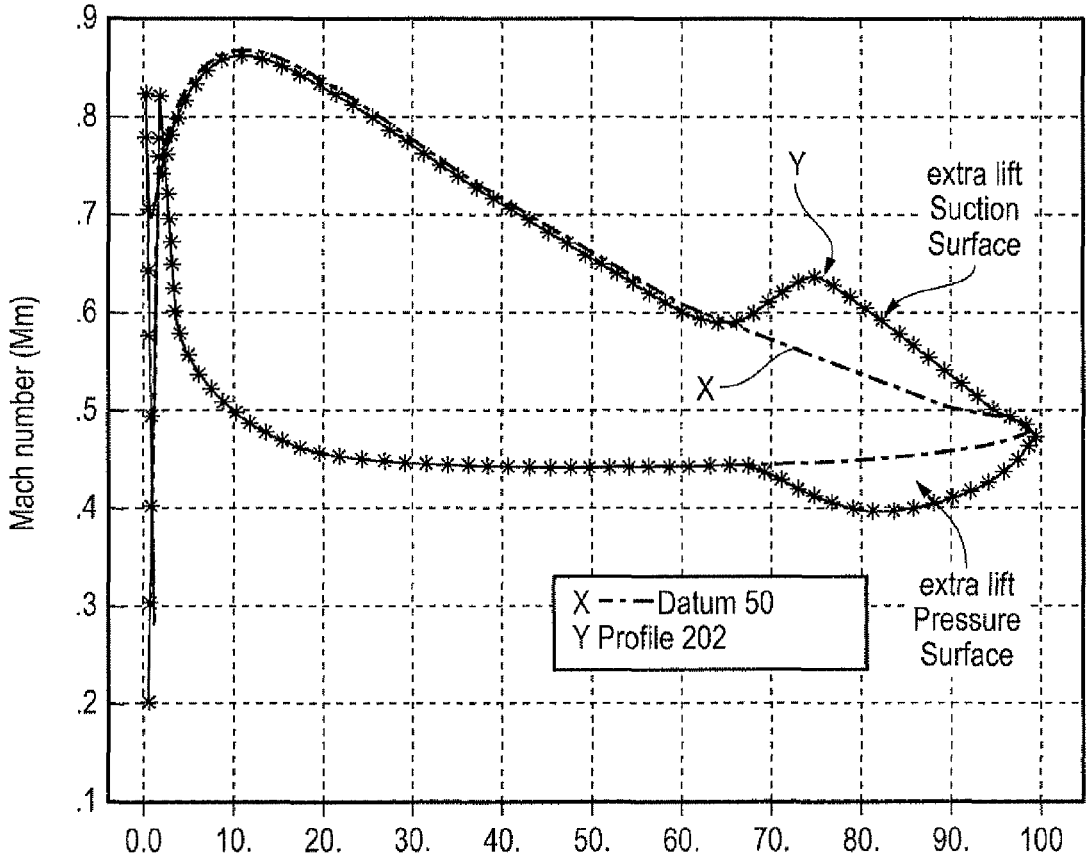
FIG. 19 is a comparison of calculated surface Mach number distributions at design flow conditions for the aerofoil sections of FIG. 18.

In an alternative construction described with reference to FIG. 18 an embodiment 202 is shown as a mid-height section of a compressor rotor aerofoil in comparison with a conventional aerofoil 50. The isentropic surface Mach number distribution for this aerofoil and as calculated by CFD at the design flow condition is shown in FIG. 19. In the embodiment the suction surface profile is similar to that described and shown in FIGS. 4, 9, 13 and 15 but the pressure surface rather than having a continuous concavity now has a local portion which is convex which leads into a more sharply concave portion towards the trailing edge. The effect of the change of profile on the pressure surface is to locally cause a sharp deceleration i.e. falling Mach number of the fluid passing over the pressure surface followed by a strong acceleration i.e. rising Mach number to the trailing edge.

The hollowing out of the pressure surface in this way and the change in Mach numbers enables the aerofoil to achieve more lift than the designs of FIGS. 4, 9, 13 and 15 which may be up to around 5% higher.

Figure 20:
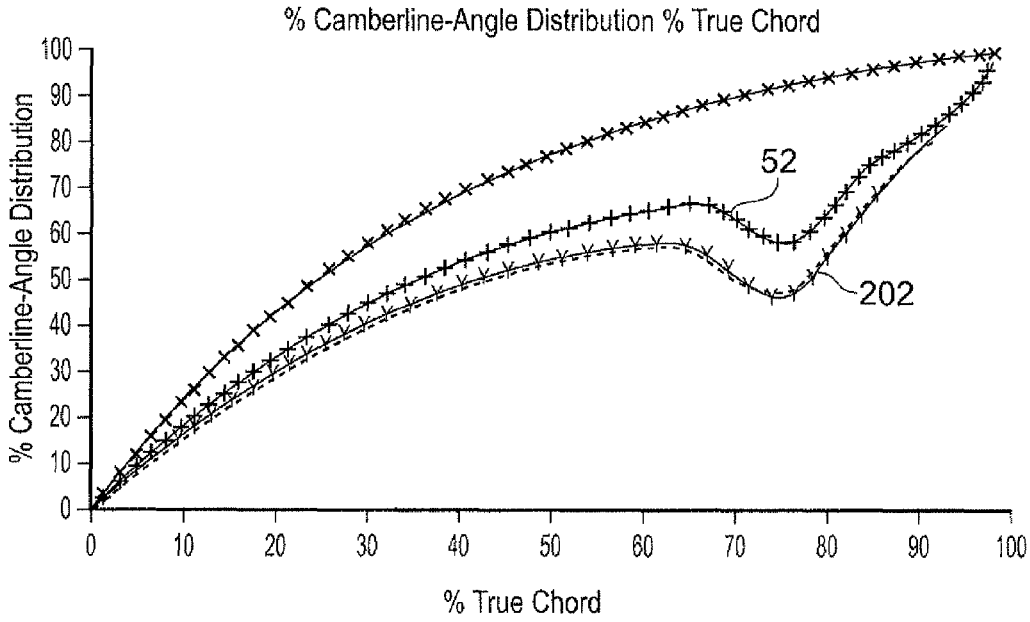
FIG. 20 is a comparison of non-dimensionalised camber distributions vs chord for the aerofoil sections of FIG. 18.
Figure 21:
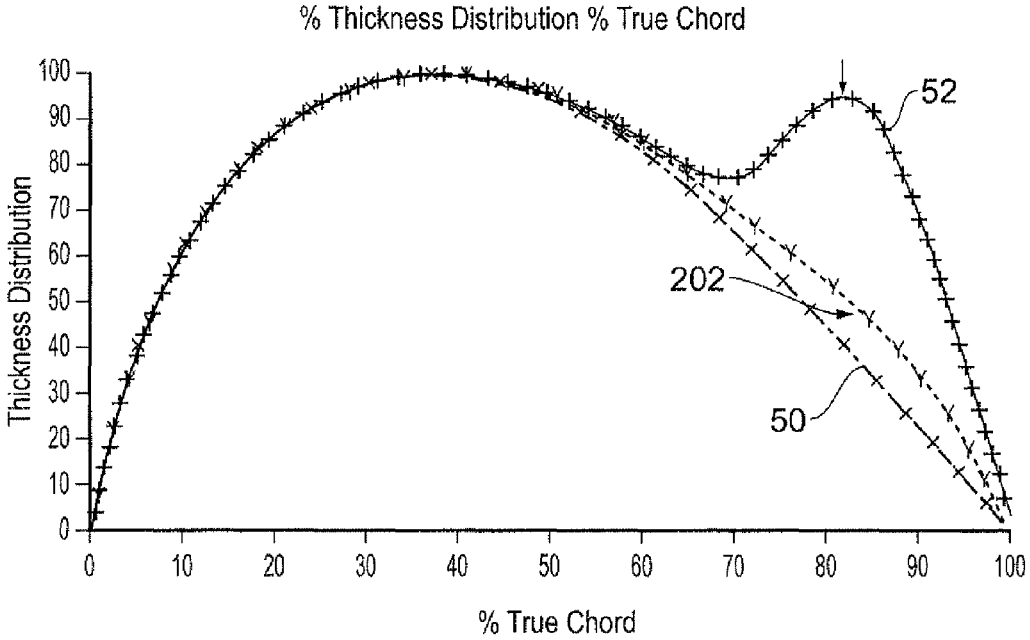
FIG. 21 is a comparison of non-dimensionalised thickness distributions vs chord for the aerofoil sections of FIG. 18.

FIGS. 20 and 21 respectively depict the non-dimensionalised camber and thickness distributions for the aerofoil 202 of FIG. 19 plotted alongside the aerofoil 52 of FIGS. 4, 9, 13 and 15. As can be seen for aerofoil 52 the camber distribution generally rises from the leading to the trailing edges but, in the rear half of the chord, falls to a local minimum before rising again. In the embodiment shown the local minimum is between 70% and 80% of the chord length from the leading edge of the blade and more preferably between 74 and 76% of the chord.

The thickness distribution in FIG. 21 differs from that of the aerofoil 52 in FIGS. 4, 9, 13 and 15 in that rather that having a region in which it increases downstream of a first thickness maxima it instead falls monotonically to the trailing edge from the first thickness maxima which, in this embodiment, is at around 40% of the chord length Also plotted is the thickness distribution of the datum 50. Advantageously, although the trailing edge thickness is less than that of the embodiments of FIGS. 4, 9, 13 and 15 the trailing edge thickness is still greater than that of a conventional high-lift aerofoil which is mechanically advantageous by reducing direct stresses which arise from forces normal to the plane of the aerofoil in this relatively thin region.

Further advantage may be observed in unsteady flow since, if the acceleration on the late pressure surface is steep enough, it is possible that the boundary layer may be thinned sufficiently such that an upstream flow feature may interact with the thinned boundary layer to generate a turbulent spot with a calmed region downstream of it. If this persists to the trailing edge it will reduce the aerodynamic profile loss of the aerofoil further and this process will be aided if the acceleration of the late pressure surface is sufficient to cause the boundary layer to thin sufficiently to re-laminarise.

Figure 22:
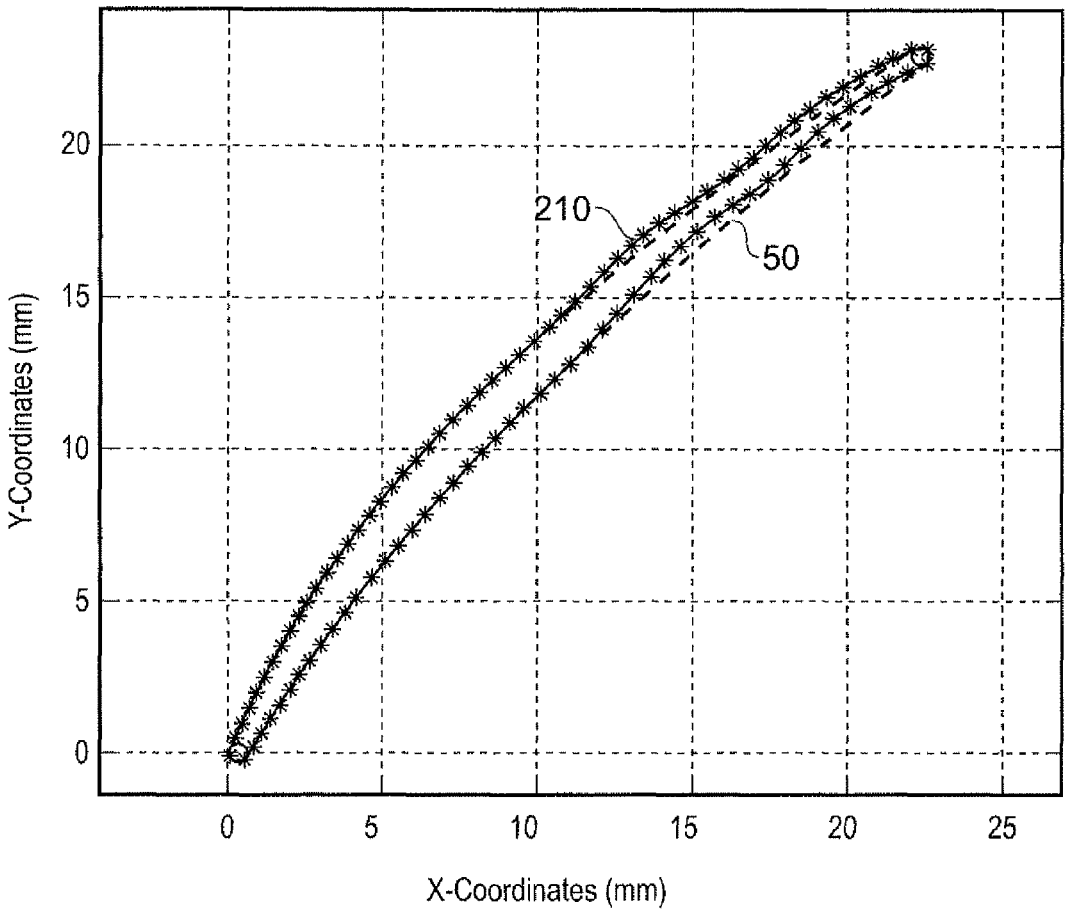
FIG. 22 is a comparison of aerofoil mid-height sections of a conventional high lift aerofoil and an alternative embodiment.
Figure 23:
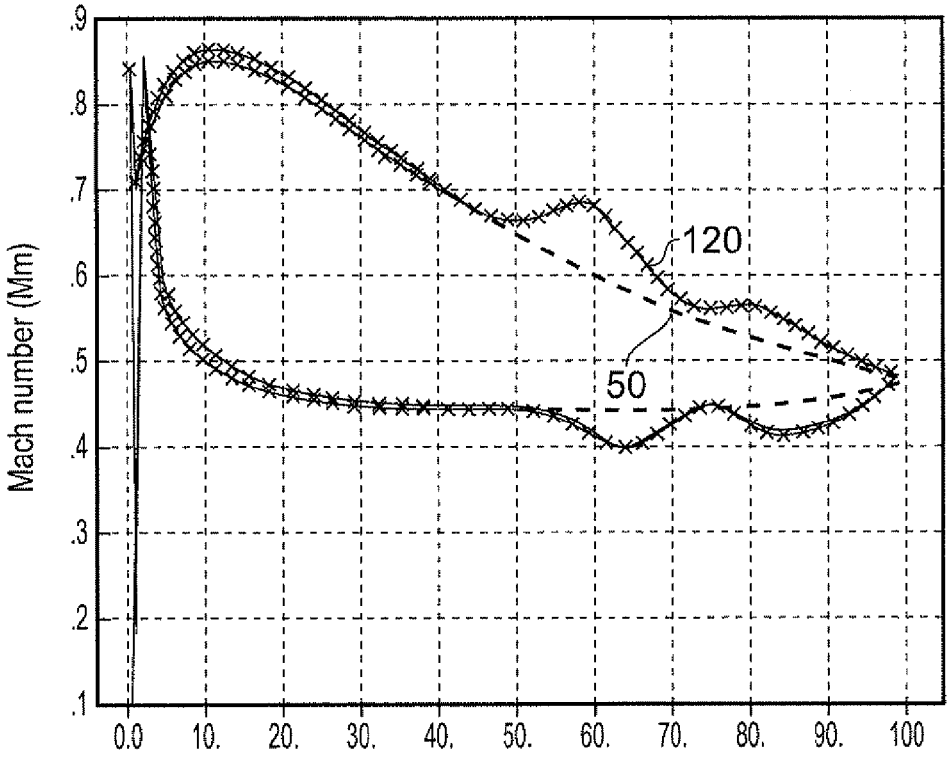
FIG. 23 is a comparison of calculated surface Mach number distributions at design flow conditions for the aerofoil sections of FIG. 22.
Figure 24:
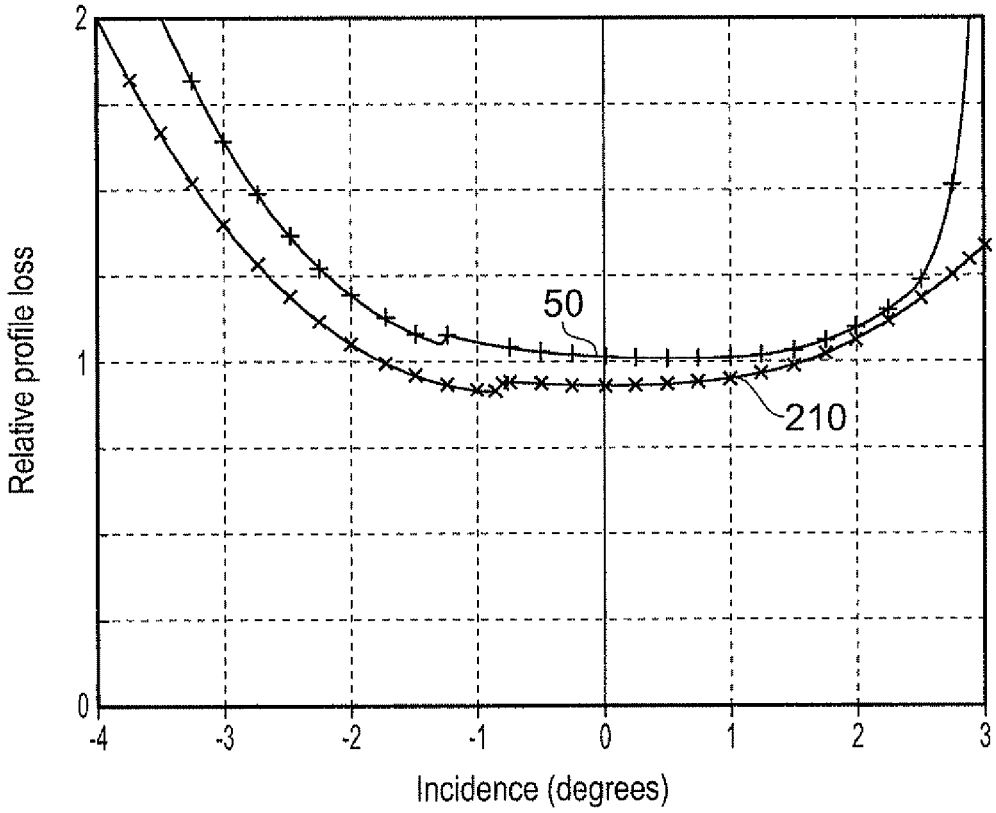
FIG. 24 is a comparison of the calculated loss loops for the aerofoil sections of FIG. 22.

A further embodiment of an aerofoil 210 is depicted in FIG. 22 in which multiple local regions of alternating convex and concave curvature are provided on the suction and pressure surfaces. The undulating suction and pressure surfaces in the rear half of the aerofoil chord achieve greater lift than that of a conventional high-lift aerofoil 50. The resultant Mach number distributions for a conventional and high lift aerofoil of this further embodiment is shown in FIG. 23. As may be observed from the graph most of the improved lift, relative to the conventional aerofoil, is in the rear half. FIG. 24 compares the loss loops for the two aerofoils shown in FIG. 22 by plotting the normalised 2-D aerodynamic loss against incidence. As described above the usual definition for the operating range of the aerofoil is to locate the points at positive and negative incidence at which the aerofoil loss is double that at the design flow condition. Outside this range the aerofoil section in taken to have stalled aerodynamically.

The further embodiment has a lower loss than conventional aerofoils which is due, in part, to the reduced wetted area since less aerofoils may be used with each aerofoil offering greater lift per aerofoil than the conventional profile. The further embodiment also provides a wider loss loop which gives an improved choke margin due to the wider loss loop at negative incidence plus an improved stall margin due to the wider loss loop at positive incidence.

Figure 25:
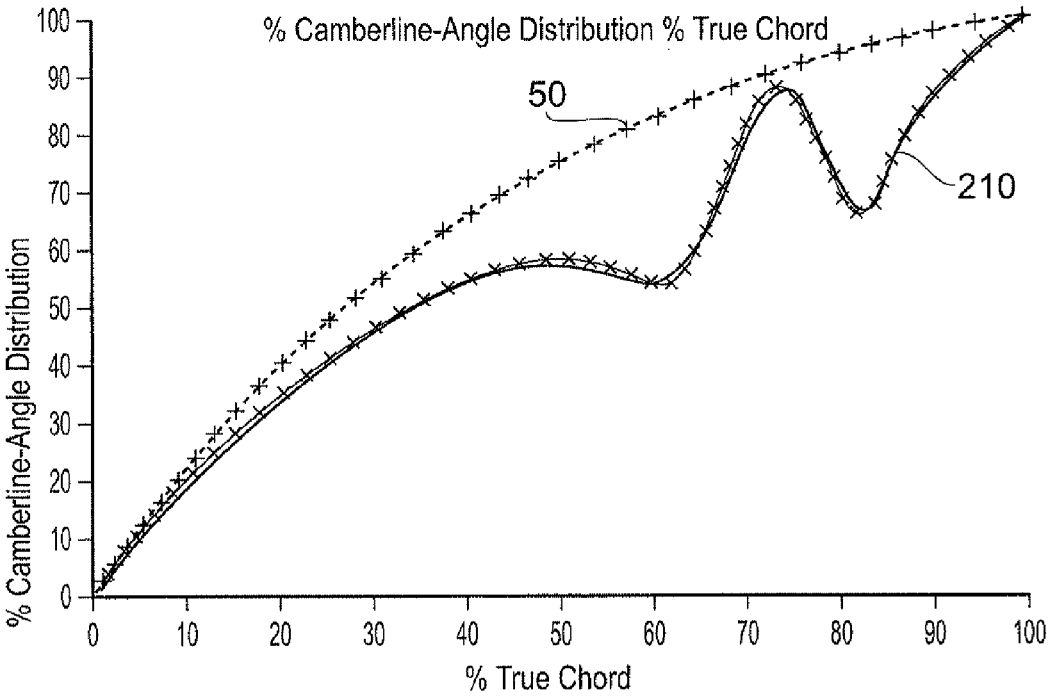
FIG. 25 is a comparison of non-dimensionalised camber distributions vs chord for the aerofoil sections of FIG. 22.
Figure 26:
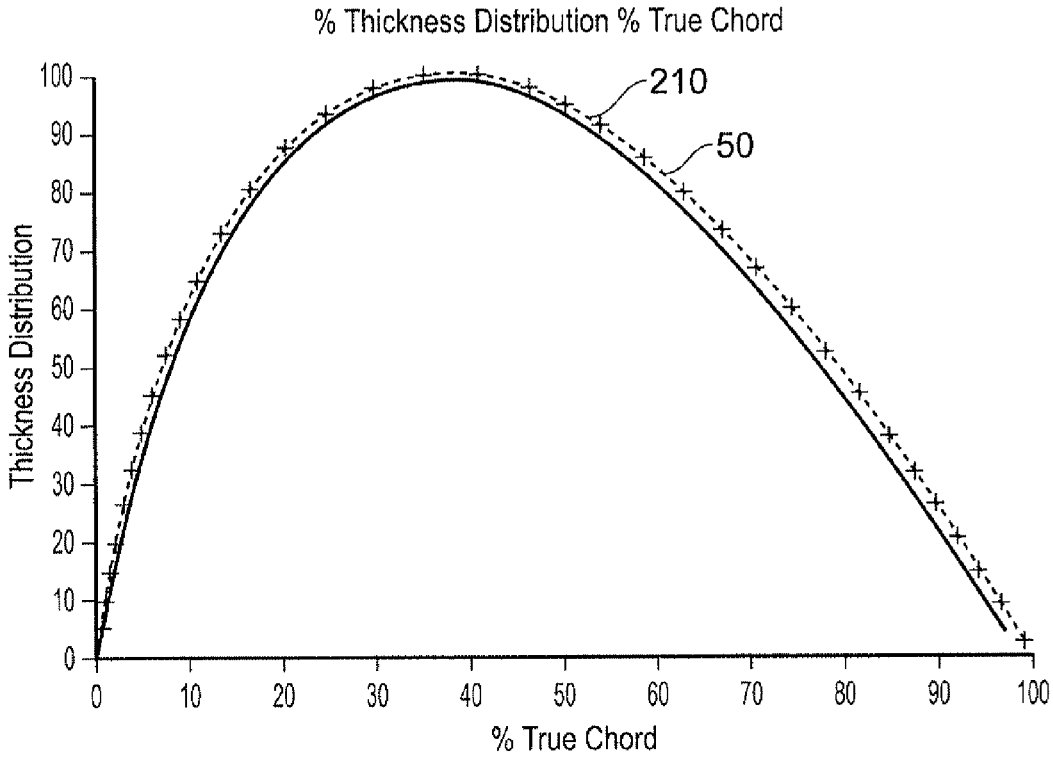
FIG. 26 is a comparison of non-dimensionalised thickness distributions vs chord for the aerofoil sections of FIG. 22.

The geometric characterisation of the embodiment is depicted in FIGS. 25 and 26 which present respectively the non-dimensionalised camber (UCD) and thickness (UTD) distributions of the aerofoil sections for both the datum aerofoil 50 and the embodiment of FIG. 23 210. The UCD, for a particular position c along the camber line is determined by the function:

$$\frac{\alpha_1 - \alpha_c}{\alpha_1 - \alpha_2}$$

where, $\alpha_1$ is the blade inlet angle; $\alpha_2$ is the blade outlet angle; and $\alpha_c$ is the angle of the tangent to the camber line to the axial direction at point c along the camber line.

The non-dimensional value of UTD for a given half thickness of the aerofoil $t_i$ is calculated using the maximum half thickness value of the aerofoil $t_{max}$ and the half thickness $t_{ie}$ from the centre of the leading edge circle or ellipse to the suction or pressure side surface measured along a line perpendicular to the tangent of the camber using the function:

$$\frac{t_i - t_{ie}}{t_{max} - t_{ie}}$$

The UCD curve rises from 0% and the leading edge to 100% at the trailing edge and there are two local minima in the rear half of the aerofoil with a local maximum between them. In the embodiment shown the minima in UCD are at about 65% and 85% chord. The UTD distribution has a monotonic rise from the leading edge to a maximum in the front half of the aerofoil, at about 40% chord, and then has a monotonic fall to the trailing edge.

Although the above embodiments have been described with respect to two-dimensional aerofoil shapes the advantage also translates to three dimensional rotors of high efficiency compressors. FIG. 27 depicts a six stage high pressure compressor having shroudless rotor blades. The compressor has six rotor blades R1 . . . R6 and six stator vanes S1 . . . S6. As may be observed from the figure the annulus area, which is the area between the radially inner wall 220 and the radially outer wall 230 contracts between the inlet and the final rotor stage and accordingly the aerofoil spans reduce. The absolute values of the rotor tip clearance are typically a function of the outer annulus diameter which may be almost constant which means that the relative clearance, which is the ratio of tip gap vs span increases through the compressor with rotor 6 having the highest relative clearance. At over speed conditions where the compressor rotates at non-dimensional speeds above the design value, the aerofoils in the rear half of the high pressure compressor can go into a more positive incidence which is additive to the normal effect of throttling the compressor which also moves the aerofoils into a positive incidence. The increased positive incidence means that, at over speed conditions, it is the stalling of the rear stages that defines the surge margin of the compressor.

Further deleterious losses in three dimensional flows may be observed at the hub where hub secondary flow arises from over turning of the boundary layer on the hub end wall 222 where low momentum fluid is significantly deflected by the cross-passage static pressure gradient much more than the mainstream flow is turned. The deflected low momentum fluid can then roll up into a vortical structure which can mix out to generate additional loss and cause non ideal flow conditions to be delivered to any downstream blade row degrading its aerodynamic performance too. The effect of a secondary flow vortex on the rotor row exit flow field is to cause over turning of the flow near the end wall and a corresponding under turning of the flow away from the end wall and in severe cases the low momentum fluid may stall in the corner between the hub 222 and the aerofoil suction surface and this typically may happen as the compressor is throttled. The corner separation is a source of high aerodynamic loss and can even cause compressor surge if the separation grows large enough.

Additionally aerofoils are also subject to over tip leakage flow since for shroudless rotor blades and stators there is a clearance gap between the tips of the moving blades and the static casing, in the case of rotors, and between the hubs of the static blades and the moving hub end wall in the case of stators. As a result there is a leakage flow through the clearance gaps, from the pressure surface to the suction surface. The leakage flow degrades the aerodynamic efficiency and in some cases reduces the surge margin.

One of the implications of using high lift aerofoils in a compressor is that fewer blades may be used, which may be around 15% less, which offers advantages in both reduced cost and weight.

To further improve the surge margin of the high lift aerofoils the tip, or outer 30% of the rotor blades, may be modified such that the exit flow area of the aerofoil sections in this region are progressively increased in order to mitigate the deleterious effect of the over tip leakage.

Figure 28:
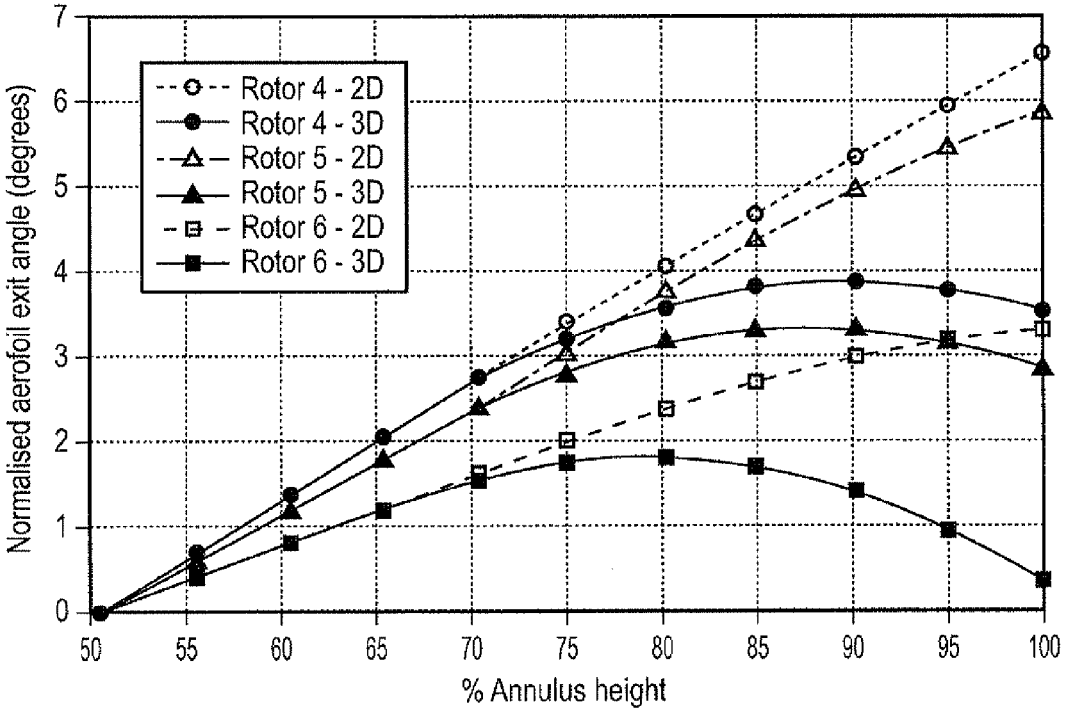
FIG. 28 is a comparison of normalised blade exit angles in outer half span of rotors with and without tip treatment.
Figure 29:
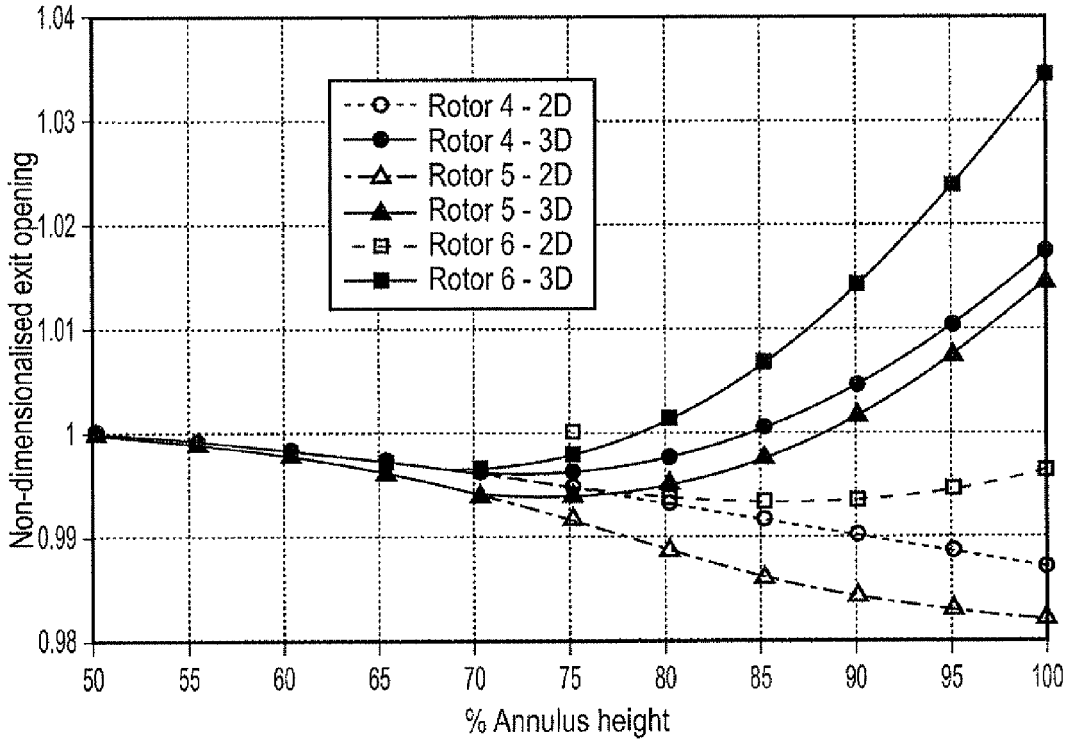
FIG. 29 is a comparison of non-dimensionalised blade passage exit opening in outer half-span of rotors with (3D) and without (2D) tip treatment.

Each of the blades has an exit angle which is calculated during the 20 analysis. In the three-dimensional aerofoil shape the exit angle in the tip region is reduced from the values calculated in their two dimensional design. In the embodiment shown the reduction is 3° at the radially outer extremity of the blade and which is scaled down to 0° at 70% height. The radial profile of the exit angles for the outer half span of rotors 4, 5 and 6 of FIG. 28 which is normalised by their corresponding mid-height values is depicted in FIG. 29. Also shown by contrast are the unmodified values of the exit angles calculated in the two dimensional analysis.

The modified blade geometry may be selected to satisfy the following criteria where a non-dimensionalised blade passage exit opening (μ) over the outer half span for the rotors is defined as:

$$[s \times \cos(\alpha_2)]_{local} / [s \times \cos(\alpha)]_{mid\text{-}height} = \mu$$

Where s is the pitch at the trailing edge and $\alpha_2$ the blade exit angle.

The profiles of μ for the outer half of rotors 4, 5 and 6 with and without the tip treatment are shown in FIG. 29. For the three dimensional geometry the parameter μ increases steadily from 70% height to the radially outer extremity of the blade. For these rotors the values at the tip are from 2% to 3.5% above the corresponding values at the reference 70% height.

The values defining the tip treatment quoted so far are for the specific rotors in this multi-stage HPC. Depending on a number of factors such as aerofoil turning and tip clearance these may vary significantly for other applications. The radial starting point of the tip treatment may lie in the range 60% to 80% span, the value of parameter μ may vary from 1% to 12% above the value at the reference height. The modification may also be made to the tips, in this case the radially inner extremity of shroudless stators. In this case the reference height would be 40% to 20% of span and the parameter μ would increase steadily from this reference height down to the hub.

Figure 30:
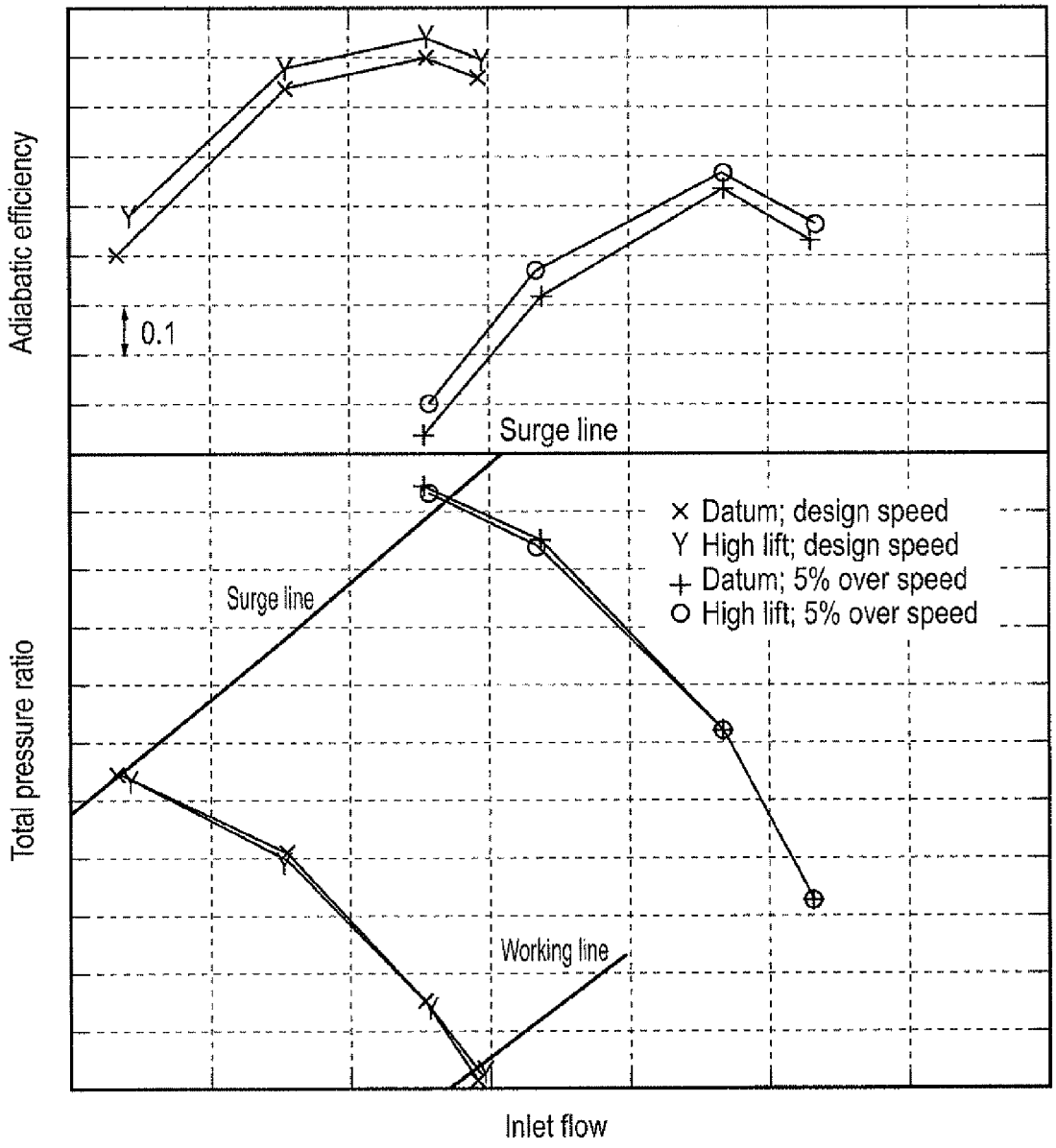
FIG. 30 is the overall characteristics for a 6-stage High Pressure Compressor.

The characteristics of the conventional high lift aerofoils and new high lift aerofoils (rotor 4, 5 and 6) HPCs for the compressor of FIG. 27 are described with reference to FIG. 30. The characteristics are calculated by steady flow CFD, at design speed and 5% over speed conditions and are in the form of curves of overall pressure ratio and adiabatic efficiency (y axes) against inlet flow (x axis).

As seen the total pressure ratio curves of each compressor as they are throttled (inlet flow reduced) are close to identical, at both speeds but the compressor with high lift rotors achieves a small increase in overall efficiency. Reducing the blade count by 15% in the rear three rotors has been achieved without any loss of efficiency or surge margin.

Figure 31:
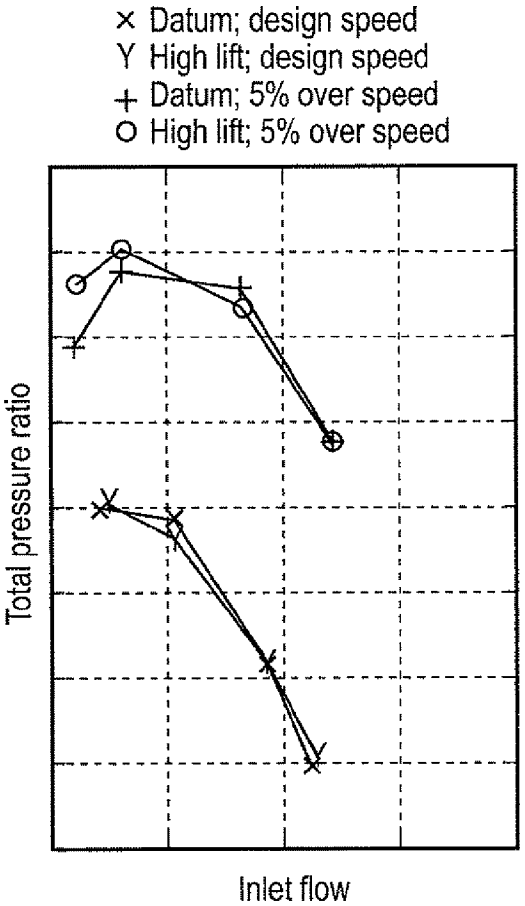
FIG. 31 is the characteristics for stator 5 and rotor 6 of the High Pressure Compressor of FIG. 27.

As already noted, rotor 6 is the rotor blade most at risk of stall as it has both the largest relative tip clearance and moves farthest into positive incidence at the over speed condition. FIG. 31 plots calculated total pressure rise against inlet flow for the aerodynamic unit consisting of stator S6 and rotor R6 for the conventional and new high lift cases and at design and 5% over speed conditions.

These characteristic curves display well known behaviour. In particular, a curve may reach a maximum as the flow through the block is reduced (throttled) and the curve "turns over". This occurs when the aerofoils in the unit cannot sustain any further increase in aerodynamic loading as may occur due to major flow separation and stall at the aerofoil hub, tip and/or along the aerofoil span.

It is important to note that the unit with the high lift rotor is less prone to over turning than the conventional one.

Figure 32B:
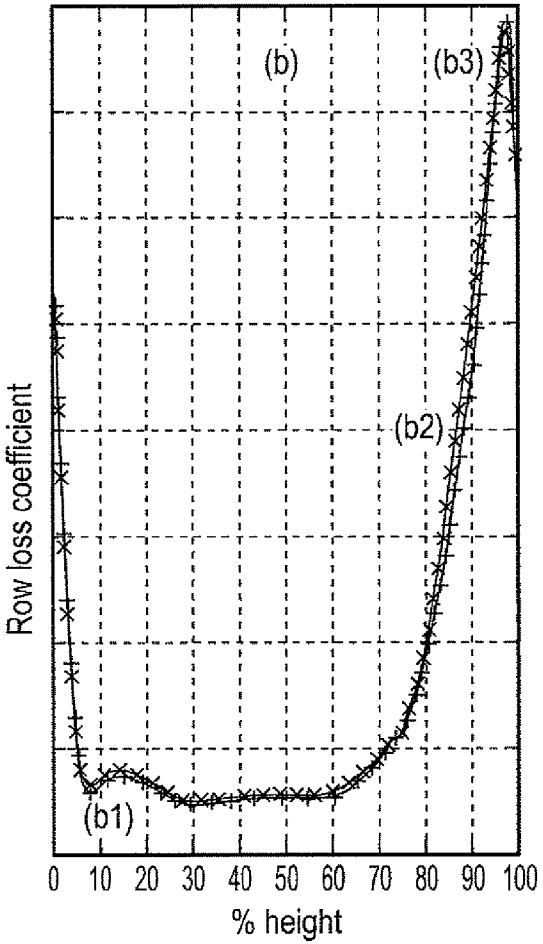
Figure 32A:
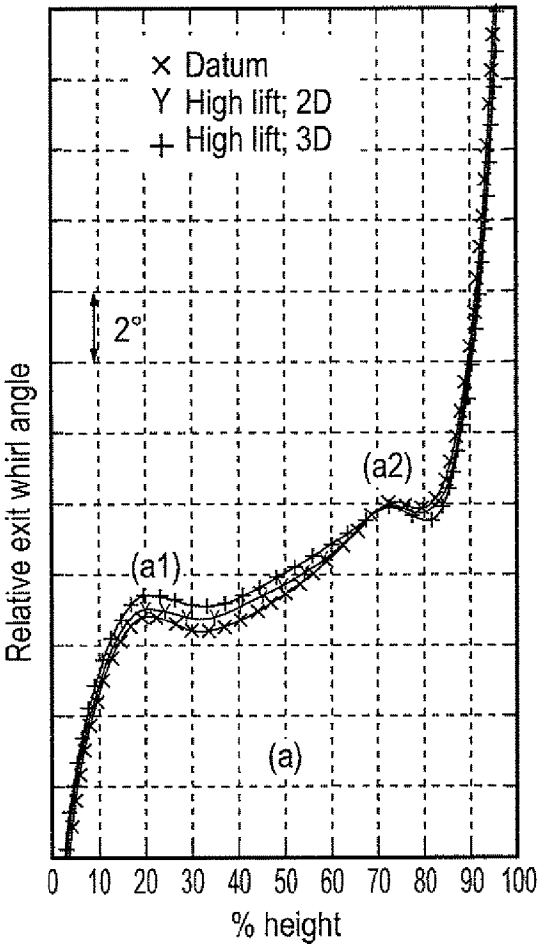

To further demonstrate the benefit of the combination of the features in the compressor, FIGS. 32*a* and 32*b* plot calculated flow field data at the exit of rotor 6, at the near surge point at design speed. FIG. 32*a* plots the radial profile of exit flow angle and FIG. 32*b* the radial profile of row loss. Curves are shown for the conventional design and the "2D" and "3D" versions of the high lift rotor.

As may be observed within the hub region the flow out of the "2D" high lift rotor is under turned relative to the conventional high lift aerofoil. By applying a profile to the hub, or end wall the effects of the hub secondary flow in this region can be mitigated to restore the exit angle to almost datum values. There is a small reduction in the loss around a1—7% to 15%—span. At the tip, the "2D" high lift rotor also experiences under turning (a2) due to increased over tip leakage flow. Application of the tip treatment largely restores this to the datum value. The "3D" version of the high lift rotor in FIGS. 32(*a*) and 32(*b*) incorporates both the hub end wall profile and the tip treatment, which are not present in the "2D" version.

The high lift rotor concentrates the over tip leakage loss closer to the tip. Thus the loss is reduced in the region 80% to 95% span (b2) but is higher next to the casing (b3). The improved exit angle due to the tip treatment comes at the cost of a small increase in loss at the tip (b3).

Beneficially, the aerofoil profiles described herein improve the off-design performance of the aerofoil. The range of inlet flow angles that the aerofoil can tolerate before experiencing breakdown of the flow is increased. As a result the surge margin of the compressor may be increased.

The aerofoil may be thickened relative to conventional designs and the cross-sectional area increased thus making the aerofoil mechanically stronger, in what is typically the thinnest (and thus weakest) portion of the aerofoil. The aerofoils described herein allows the aerofoil to be strengthened to some extent without thickening in the front portion of the aerofoil which adds an aerodynamic penalty. In some circumstances where extra cross-sectional area in the rear portion of the aerofoil is permitted this may allow the thickness at the front to be reduced, resulting in a further reduction in aerodynamic loss. For most blade rows, whether stators or rotors, the strengthening effect will be greatest in the case where the thickening runs along the whole span of the aerofoil—starting from the end (or ends) where the aerofoil is fixed (which may be the hub and/or the casing).

The additional aerodynamic loading in the rear part of the aerofoil may further act to reduce "secondary flows" in the aerofoil passage. These arise from over turning of the end wall boundary layer on either or both of the two end walls which roll up into vortical structures. These mix out to generate additional losses in themselves and cause non ideal flow conditions to be delivered to any downstream blade row, degrading its aerodynamic performance also. For conventional compressor aerofoils the forward loaded nature of the velocity distribution is known to exacerbate these effects. The invention described here, by moving some of the aerodynamic loading rearwards may act to reduce these secondary flows. This benefit will be enhanced in blade rows where the application of this invention allows the aerodynamic loading in the front part of the aerofoil to be reduced, by reducing the maximum thickness in the front half).

The invention described here, by moving some of the aerodynamic loading rearwards acts to reduce the effect of over tip leakage flows. This benefit will be enhanced in blade rows where the application of this invention allows the aerodynamic loading in the front part of the aerofoil to be reduced, by reducing the maximum thickness in the front half.

The blade profile may vary up the span of the aerofoil such that a more conventional shape is provided at the hub for blades and alternative shapes (such as ones featuring "double circular arc" camber distributions in the front half of the chord) at aerofoil platforms of stators. By this means the balance between secondary and profile losses of the aerofoil may be optimised. As the aerofoil progresses up to the tip of blades or shroudless stators or to the mid-point of stators mounted at their radially inner and outer extremities the profile may be selected to generate a more rearward loading of lift using principles describes with respect to one of the embodiments of the invention described above. The non-dimensionalised camber distribution of the aerofoil may vary along the span to provide optimum lift and stability.

The present invention may be applicable to all axial flow compressors that are highly forward loaded aerodynamically and over which the flow is largely subsonic.

In some applications the lower losses and smaller wakes shed by a blade row featuring this invention may result in lower noise, whether generated from that aerofoil directly or from interaction of the wake with a downstream row.

The invention claimed is:

1. A turbine engine compressor aerofoil comprising a leading edge, a trailing edge, a suction surface and a pressure surface between the leading edge and the trailing edge, the aerofoil further comprising in a region of a span of the aerofoil a maximum thickness of the aerofoil between the leading edge and a midpoint of the aerofoil chord and a maximum thickness of the aerofoil between the midpoint of the aerofoil chord and the trailing edge, the maximum thickness of the aerofoil between the midpoint of the aerofoil chord and the trailing edge being downstream of the maximum thickness of the aerofoil between the leading edge and a midpoint of the aerofoil chord and a first region of concave curvature in the suction surface between the two maxima, wherein the pressure surface has continuous concavity from the leading edge to at least 75% of the chord length, the aerofoil further comprises a second region of concave curvature in the suction surface, the second region of concave curvature being downstream of the maximum thickness of the aerofoil between the midpoint of the aerofoil chord and the trailing edge, the maximum thickness of the aerofoil between the midpoint of the aerofoil chord and the trailing edge immediately follows downstream of the maximum thickness of the aerofoil between the leading edge and a midpoint of the aerofoil chord, is disposed at a point in the rear third of the aerofoil chord, corresponds to a maximum thickness of the aerofoil, and is greater than a thickness of the maximum thickness of the aerofoil between the leading edge and the midpoint of the aerofoil chord.

2. An aerofoil as claimed in claim 1, wherein the aerofoil further comprises a maximum thickness of the aerofoil between the maximum thickness between the midpoint of the aerofoil chord and the trailing edge and the trailing edge, the maximum thickness of the aerofoil between the maximum thickness between the midpoint of the aerofoil chord and the trailing edge and the trailing edge being downstream of the second region of concave curvature.

3. An aerofoil as claimed in claim 1, wherein the acceleration parameter near to and upstream of the maximum thickness of the aerofoil between the midpoint of the aerofoil chord and the trailing edge exceeds a value in the range of $3.0\times10^{-6}$ to $3.5\times10^{6}$.

4. An aerofoil as claimed in claim 1, wherein the variation in the first derivative of the suction surface profile with respect to the axial chord is continuous.

5. An aerofoil as claimed in claim 1, wherein the value of the maximum thickness of the aerofoil between the midpoint of the aerofoil chord and the trailing edge varies along the region of the span of the aerofoil.

6. An aerofoil as claimed in claim 1, wherein the region extends the whole span of the aerofoil.

7. An aerofoil as claimed in claim 6, wherein the aerofoil has a secured end and a tip separated by the aerofoil span and the region is located beyond a mid-span of the aerofoil measured from the secured end.

8. An aerofoil as claimed in claim 1, wherein the aerofoil has two secured ends separated by the aerofoil span and the region is located mid-span of the aerofoil.

9. A compressor comprising the aerofoil of claim 1.

10. An aerofoil as claimed in claim 1, wherein the maximum thickness of the aerofoil between the midpoint of the aerofoil chord and the trailing edge is disposed such that in use a boundary layer upstream of the maximum thickness of the aerofoil between the midpoint of the aerofoil chord and the trailing edge on the suction surface is thinned by the maximum thickness of the aerofoil between the midpoint of the aerofoil chord and the trailing edge.

11. An aerofoil as claimed in claim 1, wherein the first region of concave curvature in the suction surface between the two maxima has a full velocity profile resembling that of a laminar boundary layer.

12. An aerofoil as claimed in claim 1, wherein the first region of concave curvature in the suction surface between the two maxima is substantially laminar.

13. An aerofoil as claimed in claim 1, wherein the pressure surface has a portion that is convex that leads into a more sharply concave portion towards the trailing edge.

14. A turbine engine compressor aerofoil comprising a leading edge, a trailing edge, a suction surface and a pressure surface between the leading edge and the trailing edge with a thickness defined therebetween, the aerofoil further comprising in a range of the span of the aerofoil a maximum thickness of the aerofoil between the leading edge and a midpoint of the aerofoil chord in the thickness distribution disposed before the midpoint of the aerofoil chord, the suction surface having a primary region of concave curvature in the suction surface aft of the maximum thickness of the aerofoil between the leading edge and the midpoint of the aerofoil chord and a region of convex curvature disposed aft of the primary region of concave curvature and the pressure surface having a primary region of convex curvature aft of the maximum thickness of the aerofoil between the leading edge and the midpoint of the aerofoil chord, wherein the aerofoil has a further region of concave curvature in the suction surface aft of the primary region of concave curvature in the suction surface.

15. A turbine engine compressor aerofoil as claimed in claim 14, wherein the thickness of the compressor aerofoil falls monotonically along the chord from the maximum thickness of the aerofoil between the leading edge and the midpoint of the aerofoil chord to the trailing edge.

16. A turbine engine compressor aerofoil according to claim 14, wherein the aerofoil has a further region of convex curvature in the pressure surface aft of the primary region of convex curvature in the pressure surface.

17. A turbine engine compressor aerofoil according to claim 14, wherein the location of the primary region of pressure surface convex curvature varies along the range of the span of the aerofoil.

18. An aerofoil as claimed in claim 14, wherein the curvature of the primary region of pressure surface convex curvature varies along the range of the span of the aerofoil.

19. A compressor comprising the aerofoil of claim 18.

20. An aerofoil as claimed in claim 14, wherein the range extends the whole span of the aerofoil.

21. An aerofoil as claimed in claim 14, wherein the aerofoil has a secured end and a tip separated by the aerofoil span and the range is located beyond mid-span of the aerofoil measured from the secured end.

22. An aerofoil as claimed in claim 14, wherein the aerofoil has two secured ends separated by the aerofoil span and the region is located mid-span of the aerofoil.

23. An aerofoil as claimed in claim 14, wherein the aerofoil has a secured end and a tip wherein the normalised aerofoil exit angle at 70% of the aerofoil span measured from the secured end is greater than the normalised exit angle at the tip.

* * * * *